US012214952B2

(12) United States Patent
Naweed

(10) Patent No.: US 12,214,952 B2
(45) Date of Patent: Feb. 4, 2025

(54) MULTI-CHAMBER MIXING BEVERAGE CONTAINER

(71) Applicant: Mohammad Ali Naweed, Lahore (PK)

(72) Inventor: Mohammad Ali Naweed, Lahore (PK)

( * ) Notice: Subject to any disclaimer, the term of this patent is extended or adjusted under 35 U.S.C. 154(b) by 0 days.

(21) Appl. No.: 17/675,037

(22) Filed: Feb. 18, 2022

(65) Prior Publication Data

US 2023/0063501 A1 Mar. 2, 2023

Related U.S. Application Data

(63) Continuation-in-part of application No. 29/810,495, filed on Oct. 5, 2021.

(60) Provisional application No. 63/239,591, filed on Sep. 1, 2021.

(51) Int. Cl.
*B65D 81/32* (2006.01)

(52) U.S. Cl.
CPC ..... *B65D 81/3211* (2013.01)

(58) Field of Classification Search
CPC . B65D 81/3211; B65D 81/3205; B65D 81/32
USPC ..... 206/221, 219
See application file for complete search history.

(56) References Cited

U.S. PATENT DOCUMENTS 7,413,074 B2 8/2008 Barr
9,708,109 B2 7/2017 Marina
2011/0233118 A1* 9/2011 Nelson ..... C02F 1/002 210/236
2011/0266247 A1 11/2011 Littrell
2017/0101252 A1* 4/2017 Acott ..... A47J 31/407
2018/0086519 A1* 3/2018 Giuliano ..... B65D 51/2878
2018/0319566 A1* 11/2018 Pan ..... B65D 1/0207
2019/0009969 A1* 1/2019 Kite ..... B65D 81/3211
2019/0053601 A1* 2/2019 Noh ..... B65D 81/32
2019/0307227 A1* 10/2019 Pardo ..... A61K 8/671
2020/0391928 A1 12/2020 Willis et al.

FOREIGN PATENT DOCUMENTS

JP 2007532416 A 11/2007

* cited by examiner

*Primary Examiner* — Steven A. Reynolds

(57) ABSTRACT

A multi-chamber mixing beverage container is used to retain and selectively mix different beverage ingredients to make and consume a custom beverage. The multi-chamber mixing beverage container may include a container body, a storage base, an additive dispensing mechanism, and a cap. The container body retains a quantity of liquid that serves as the base to mix a custom beverage. The container body further facilitates the mixing of the beverage ingredients and the ease of consumption of the custom beverage. The storage base retains different beverage ingredients separate from each other to be selectively mixed with the quantity of liquid retained within the container body. The additive dispensing mechanism enables the selective mixing of an amount of one or more beverage ingredients from the storage base with the quantity of liquid within the container body. The cap keeps the container body sealed until the mixed beverage is consumed.

5 Claims, 50 Drawing Sheets

MULTI-CHAMBER MIXING BEVERAGE CONTAINER

FIELD OF THE INVENTION

The present invention relates generally to beverage containers and beverage mixing mechanisms. More specifically, the present invention provides a novel beverage container with integrated means to enable the mixing of the beverage with multiple additives stored within the same container.

BACKGROUND OF THE INVENTION

Nowadays, beverages are provided in different configurations for the ease of consumption. Most beverages are sold premixed for quick and easy consumption by the consumer. However, there are several downsides to premixed beverages. For example, premixed beverages come with limited range of possible ingredient combinations. If the consumer wanted more or less of an ingredient, such as making the beverage sweeter or less sweet, the consumer would have no option but to mix the beverage with other ingredients not provided with the beverage. In addition, premixed beverages are restricted to a certain range of ingredients as the beverages are often manufactured for long shelf-life. This limits the use of fresh ingredients as fresh ingredients can perish faster. For example, when honey is introduced and diluted into water, the risk for introducing microorganisms to the honey increases, which can result in a spoiled honey. Further, many other ingredients such as lemon and lime juice can stay fresh for a prolonged period if the ingredients are kept separate. While the ingredients are kept separate, the ingredients also retain many of the beneficial compounds, such as vitamins.

There is growing popularity of drinks that can be mixed by the consumer according to the consumer's taste. Many are provided as additives sold separately that can be selectively added to other drinks, such as a water bottle. These include flavor enhancing products and dietary products. There are other beverages that enable the consumer to add their preferred additives, such as fresh fruits or vegetables. However, the mixing process can be a messy process and difficult to do on the go. Many companies have attempted to overcome this issue by mixing in synthetic ingredients to the beverage that are able to last longer, however this creates a cheap imitation of the natural ingredient where many of the natural benefits are lost and only a subpar taste is retained in the beverage.

Therefore, an objective of the present invention is to provide a novel beverage container that enables the consumer to selectively mix ingredients to make a beverage according to the consumer's taste. The present invention includes an integrated mechanism that enables the selective mixing of a desired amount of ingredients to make a beverage according to the consumer's taste. Another objective of the present invention is to provide a novel beverage container that enables the storage of different ingredients separate from each other within the same container. The present invention enables the consumer to keep fresh ingredients separate until the consumer wants to mix the ingredients. Another objective of the present invention is to provide a novel beverage container that can be restocked for continued uses. Additional features and benefits of the present invention are further discussed in the sections below.

SUMMARY OF THE INVENTION

The present invention is a multi-chamber mixing beverage container that enables consumers to make a custom beverage in a clean and easy manner. The present invention includes a structure designed to retain a liquid base, such as water, along with several ingredients that can be mixed with the liquid base. Each ingredient is stored separate from the other ingredients within the same structure to maintain all the ingredients fresh until the ingredients are selectively mixed. The present invention also includes means to selectively mix various amounts of the stored ingredients with the liquid base to make a beverage according to the consumer's taste.

In a preferred embodiment, the present invention includes a container base designed to retain the liquid base to be mixed with the different stored ingredients. The container base also enables the mixing of the liquid base with the stored ingredients as well as the easy consumption of the mixed beverage. The present invention further includes a storage base designed to retain different ingredients or additives to be mixed with the liquid base separate from each other until mixing. Further, the present invention further includes an additive dispensing mechanism which enables the consumer to selectively mix the liquid base with a desired amount of any of the ingredients stored in the storage base.

DETAIL DESCRIPTIONS OF THE INVENTION

Figure 1:
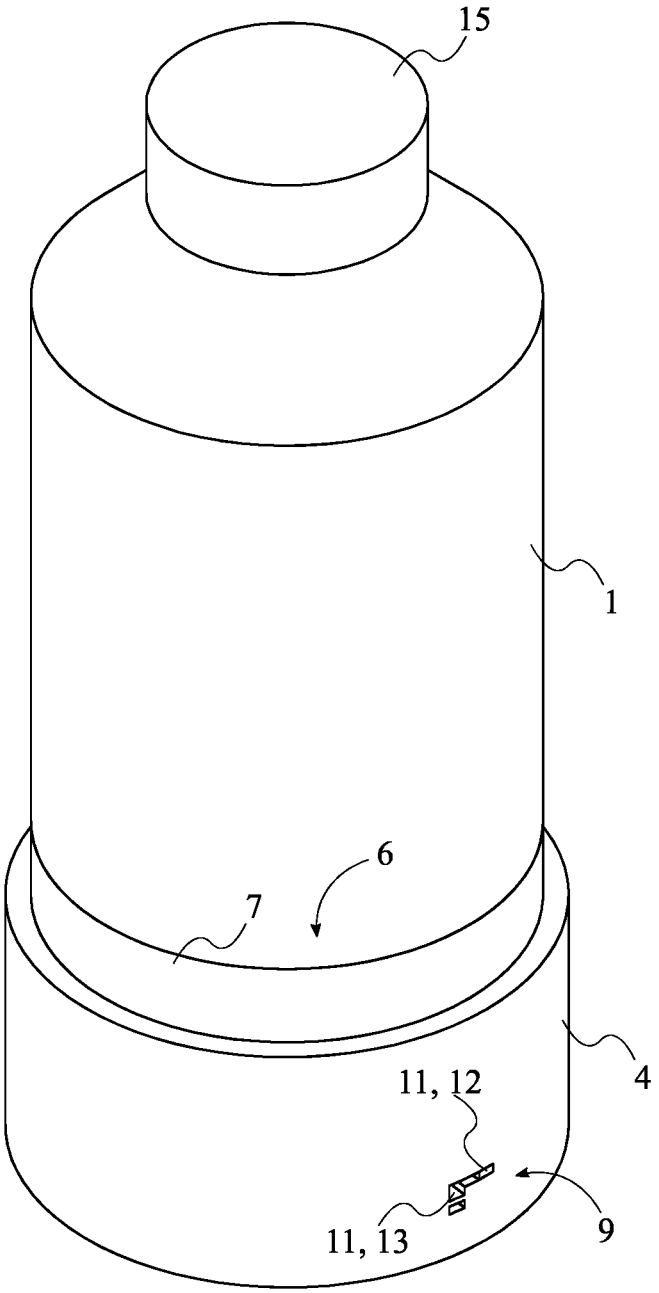
FIG. 1 is a top-front perspective view showing the first one-step embodiment of the present invention.
Figure 2:
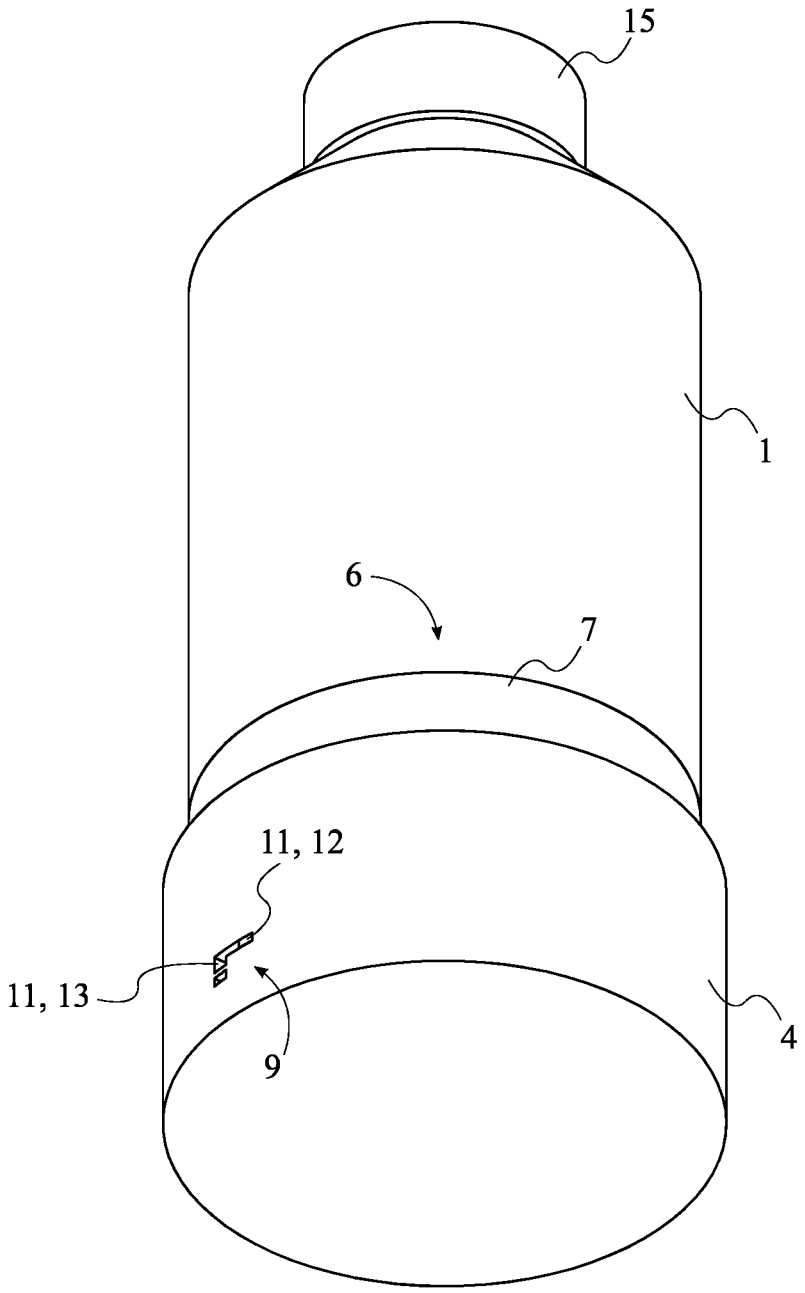
FIG. 2 is a bottom-rear perspective view showing the first one-step embodiment of the present invention.
Figure 3:
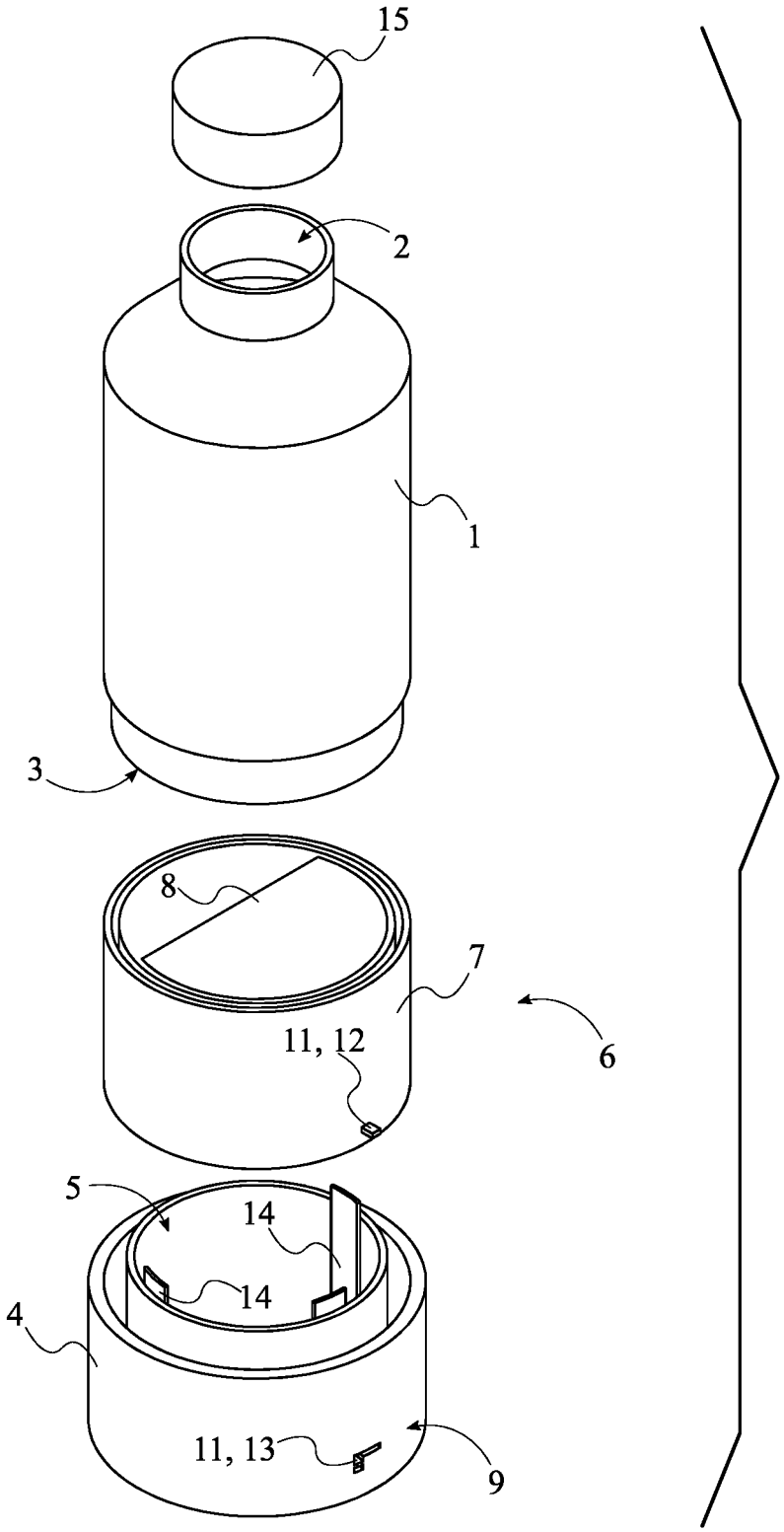
FIG. 3 is a top-front-exploded perspective view showing the first one-step embodiment of the present invention.
Figure 4:
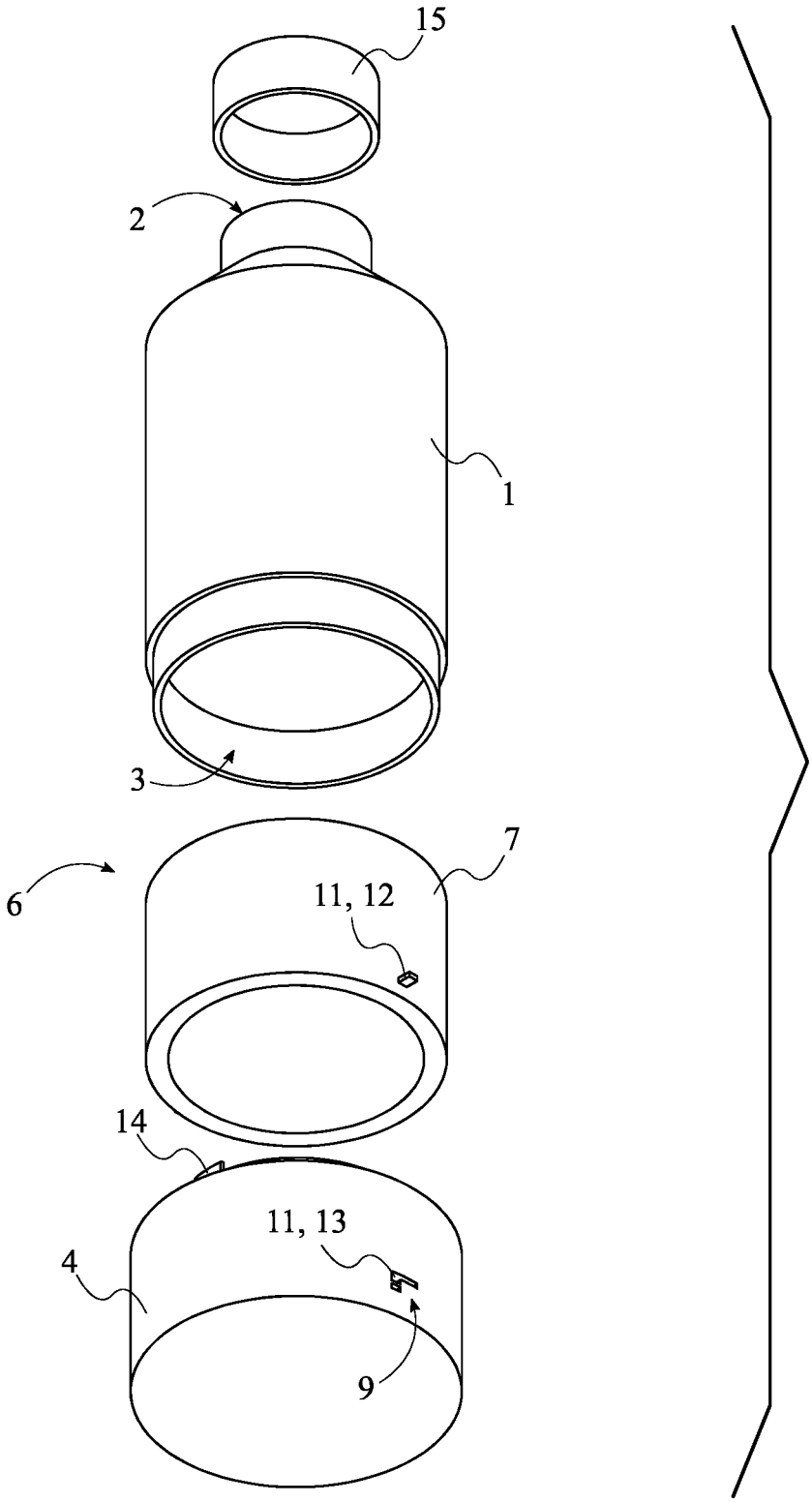
FIG. 4 is a bottom-rear-exploded perspective view showing the first one-step embodiment of the present invention.
Figure 5:
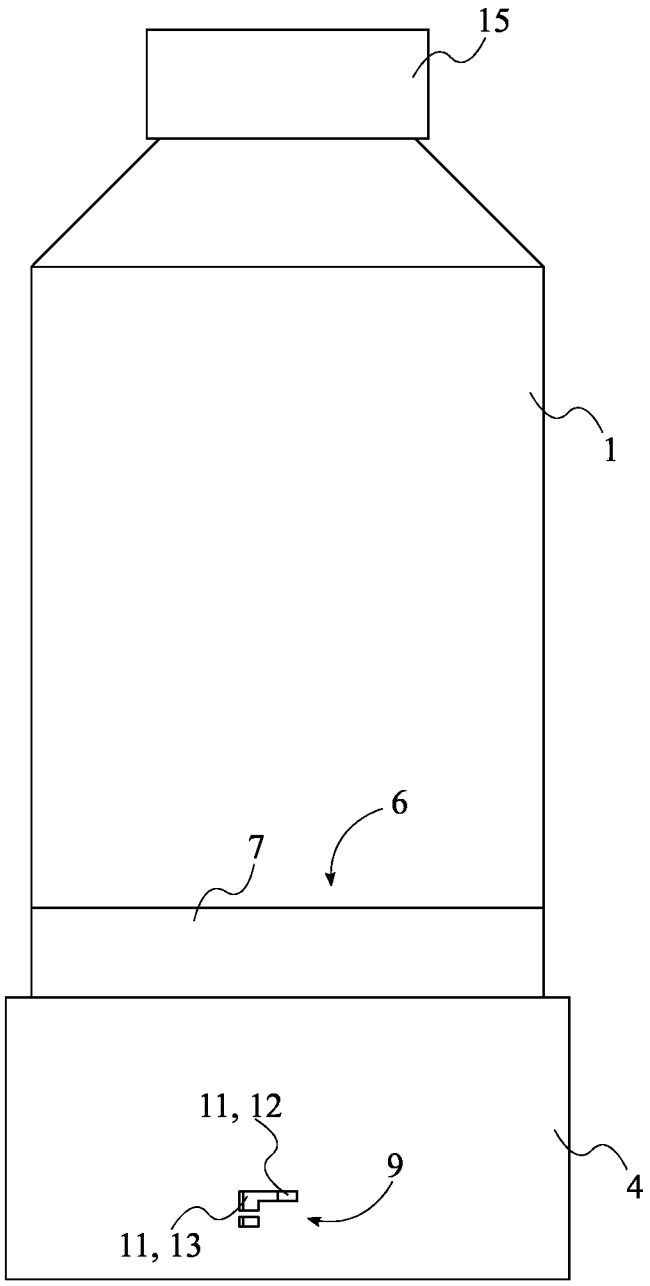
FIG. 5 is a front view of the first one-step embodiment of the present invention.
Figure 6:
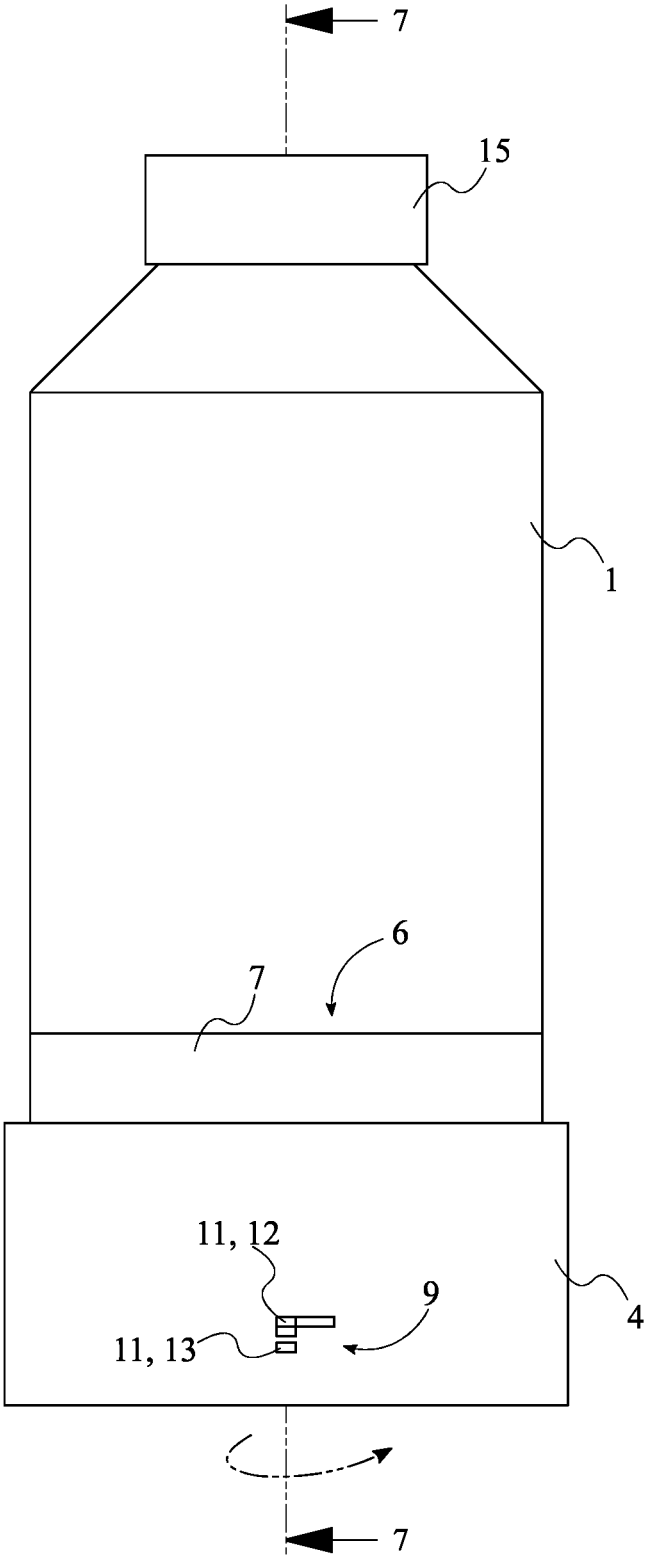
FIG. 6 is a front view of the first one-step embodiment of the present invention, wherein the storage base is shown rotated counterclockwise.
Figure 7:
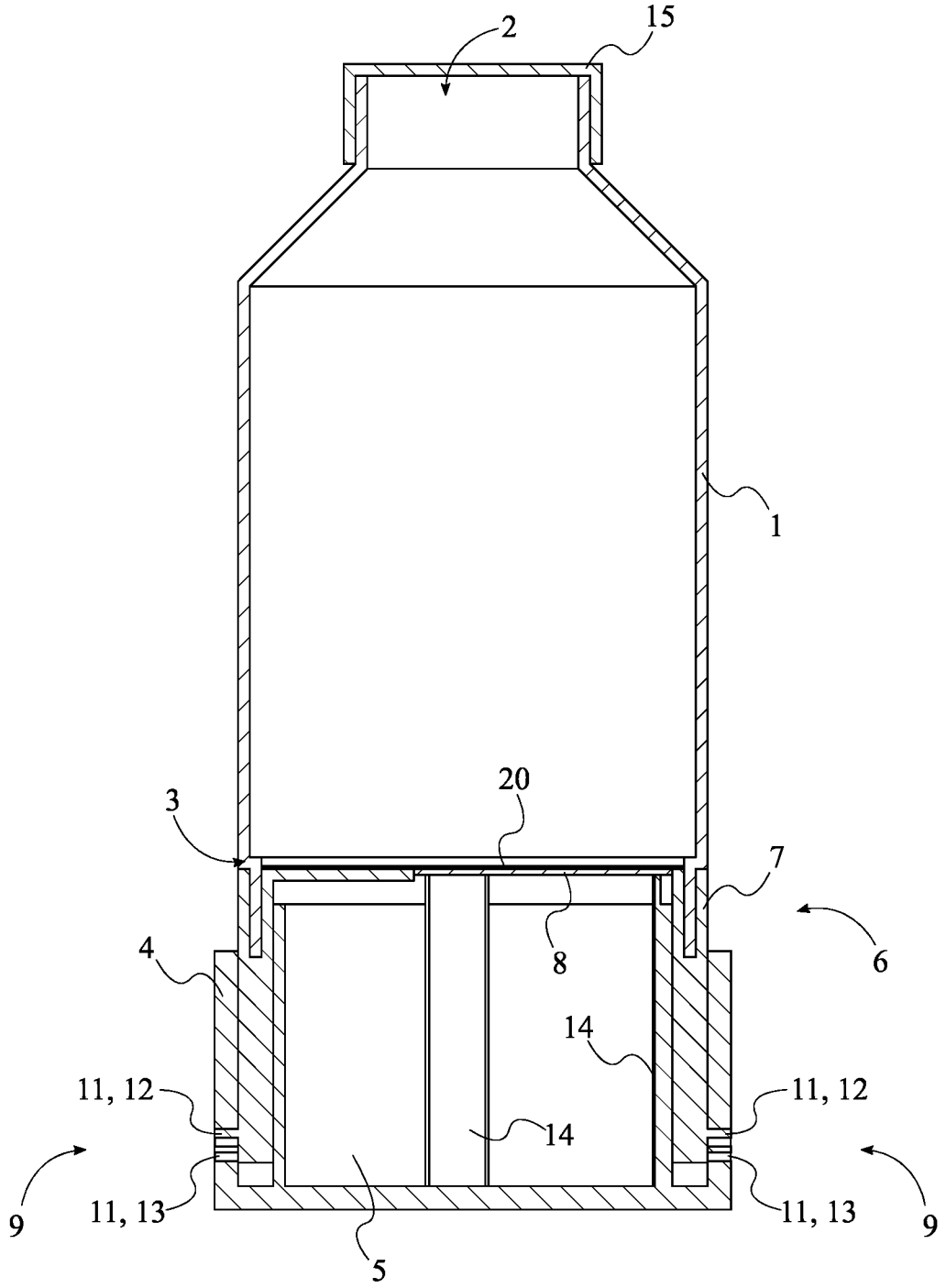
FIG. 7 is a vertical cross-sectional view of the first one-step embodiment of the present invention taken in the direction of line 7-7 in FIG. 6.
Figure 8:
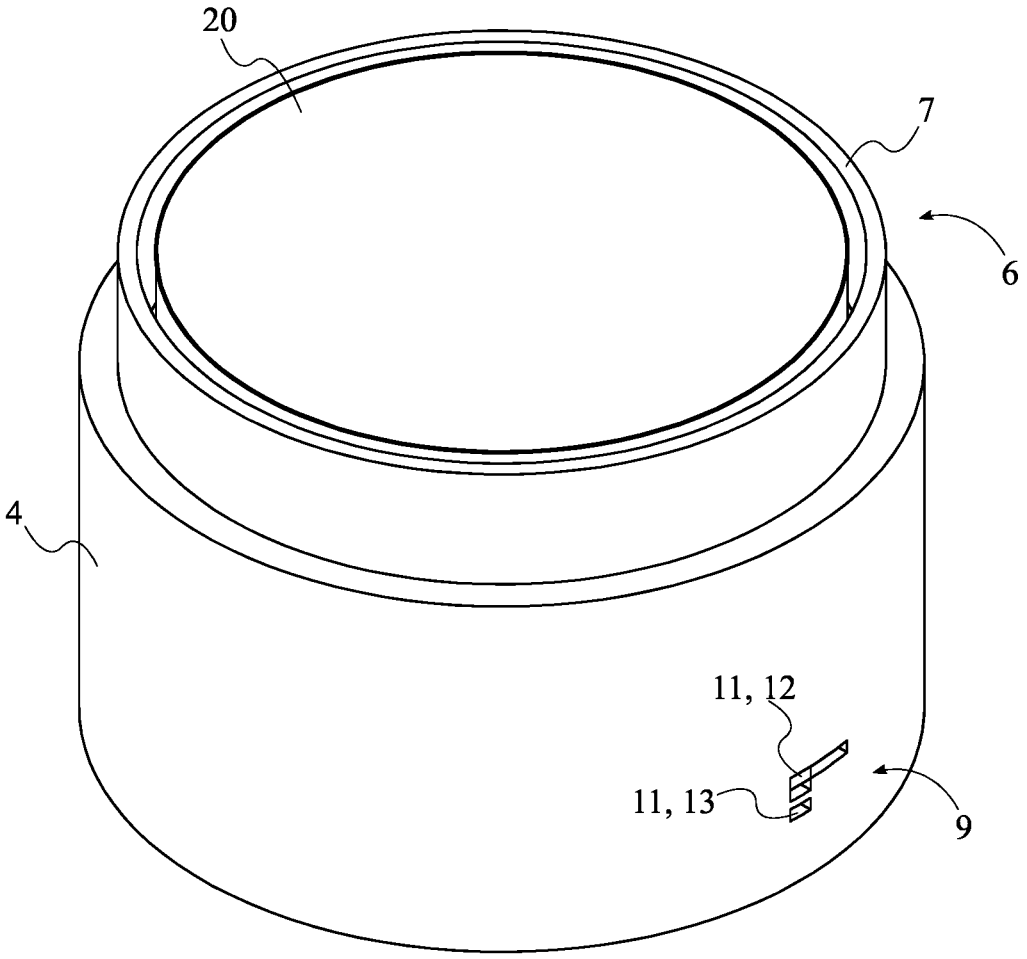
FIG. 8 is a top-front perspective view showing the sealed storage chamber of the first one-step embodiment of the present invention.
Figure 9:
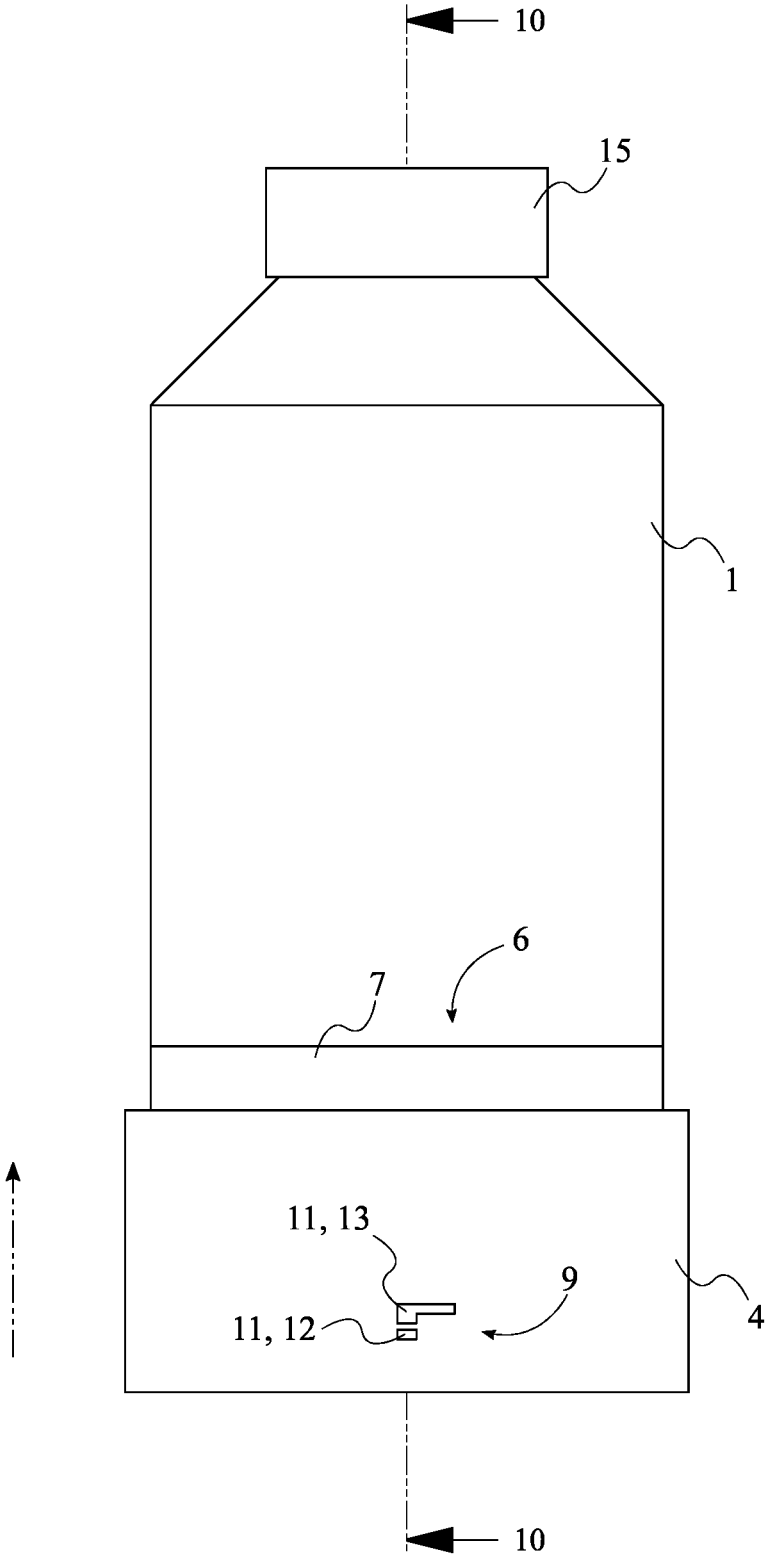
FIG. 9 is a front view of the first one-step embodiment of the present invention, wherein the storage base is shown pushed towards the container body.
Figure 10:
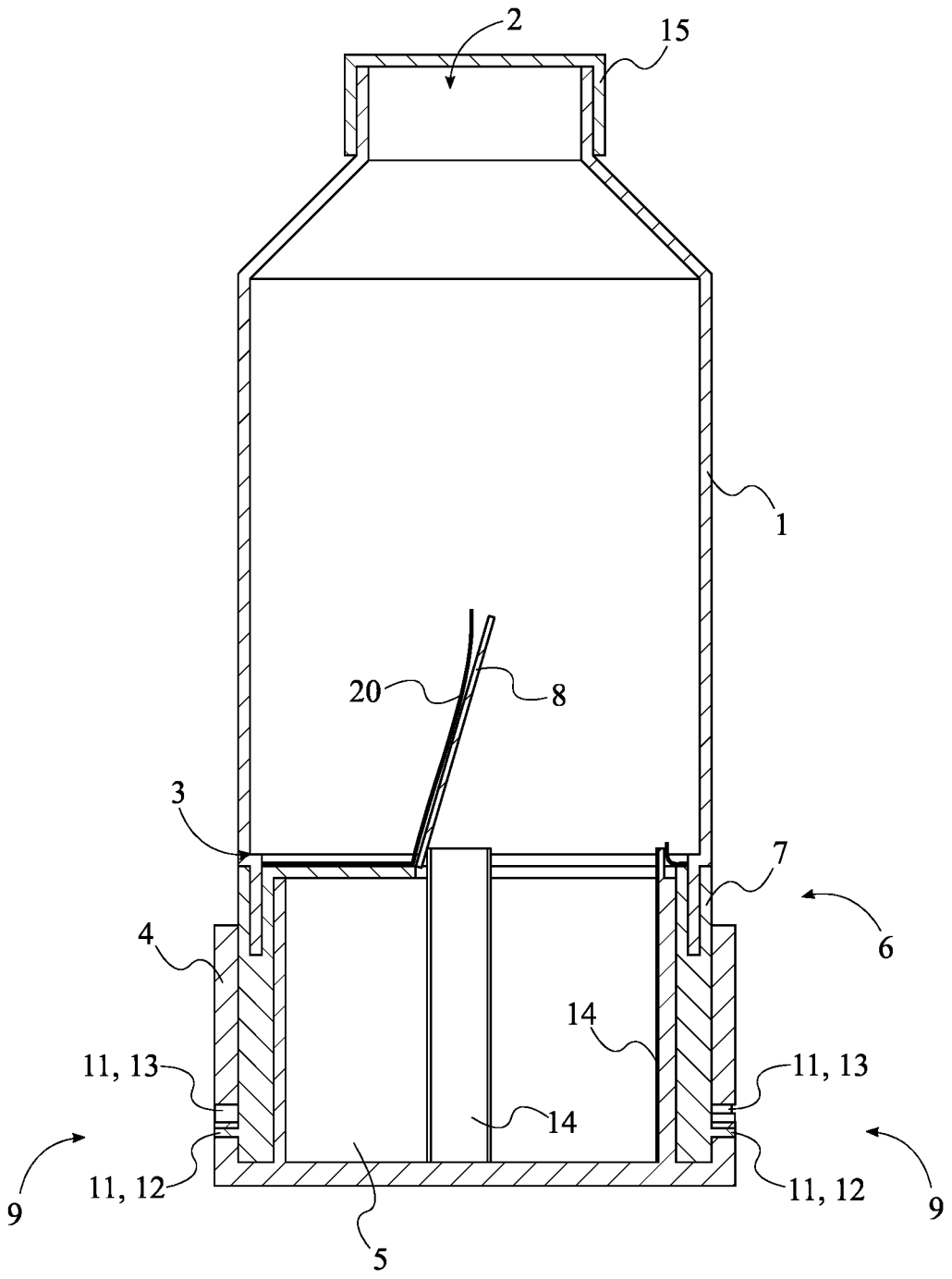
FIG. 10 is a vertical cross-sectional view of the first one-step embodiment of the present invention taken in the direction of line 10-10 in FIG. 9.
Figure 11:
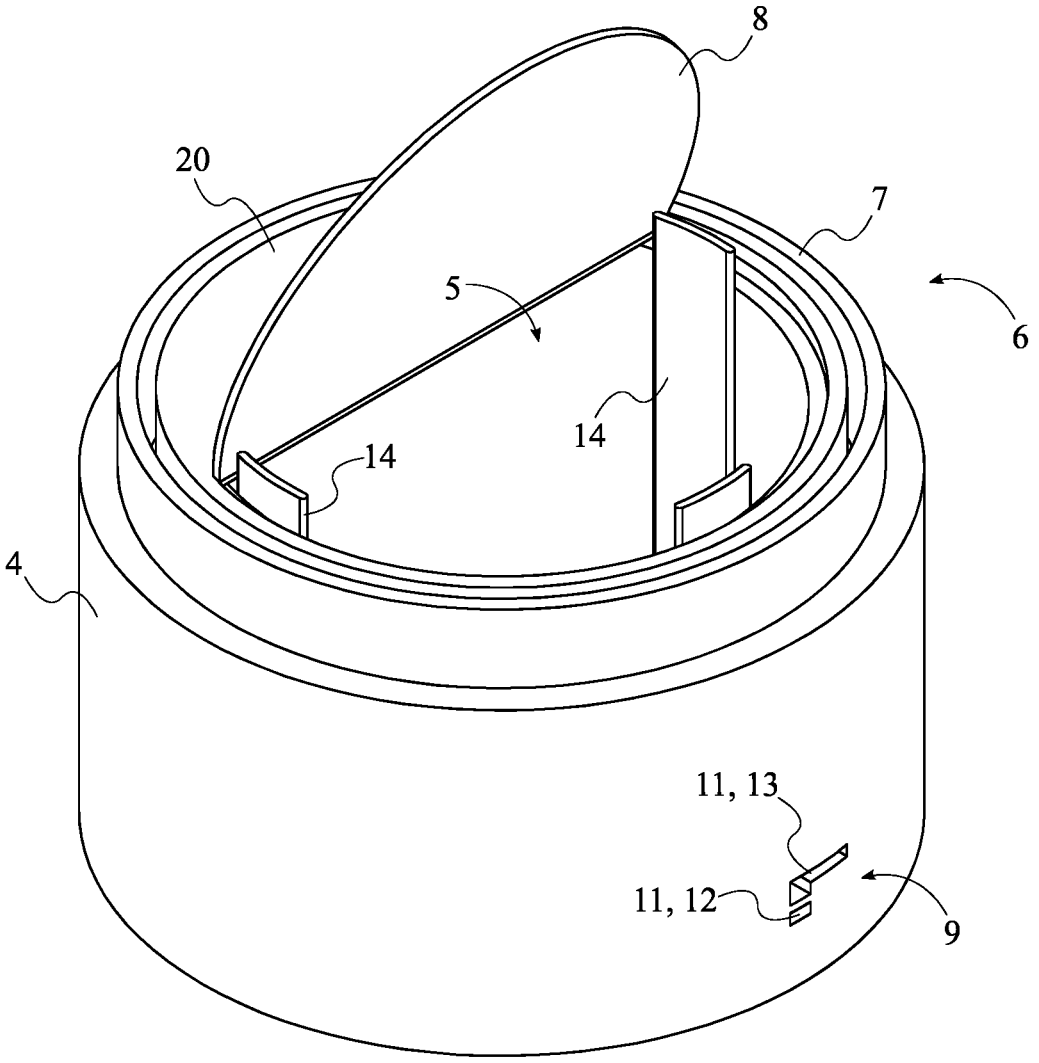
FIG. 11 is a top-front perspective view showing the unsealed storage chamber of the first one-step embodiment of the present invention.

All illustrations of the drawings are for the purpose of describing selected versions of the present invention and are not intended to limit the scope of the present invention.

The present invention is a multi-chamber mixing beverage container that is used to retain and selectively mix different beverage ingredients to make and consume a custom beverage. As can be seen in FIG. 1 through 4, 15 through 18, 32 through 35, 46, and 47, the present invention may comprise a container body 1, a storage base 4, an additive dispensing mechanism 9, and a cap 15. The container body 1 retains a quantity of liquid that serves as the base to mix a custom beverage. The container body 1 further facilitates the mixing of the desired beverage ingredients and the ease of consumption of the custom beverage. The storage base 4 retains different beverage ingredients separate from each other to be selectively mixed with the quantity of liquid retained within the container body 1. The additive dispensing mechanism 9 enables the selective mixing of an amount of one or more beverage ingredients from the storage base 4 with the quantity of liquid within the container body 1. The cap 15 keeps the container body 1 sealed until the mixed beverage is to be consumed.

The general configuration of the aforementioned components enables consumers to carry the necessary ingredients to mix a custom beverage in a practical manner with the use of a single device. To do so, the container body 1 is designed to safely retain a quantity of liquid that serves as the liquid base for the custom beverage. As can be seen in FIG. 1 through 4, 15 through 18, 32 through 35, 46, and 47, the container body 1 is preferably a hollow cylindrical and open-ended structure designed to retain different quantities of liquid. For example, the container body 1 can be manufactured to retain small quantities of liquid, medium quantities of liquid, or large quantities of liquid. Further, the container body 1 can be made from different materials, such as plastic or glass. For example, the container body 1 can be made using polyethylene terephthalate (PET) to manufacture a PET preform. The PET preform can then be shaped into the desired shape and size using blow molding techniques. The PET preform may be molded into a 150-milliliter (ml) container, a 350-ml container, or a 500-ml container. Further, the PET preform may be molded into larger container bodies, such as 2.5-liter (L) containers, to hold larger quantities of liquid. However, other manufacturing techniques can be utilized to manufacture the container body 1. Due to the cylindrical and open-ended design of the container body 1, the container body 1 comprises a first open end 2 and a second open end 3. Similar to the container body 1, the storage base 4 is an overall cylindrical structure with a cross-sectional shape and size preferably matching the shape and size of the cross-section of the container body 1.

As can be seen in FIG. 1 through 4, 15 through 18, 32 through 35, 46, and 47, to store the different beverage ingredients, the storage base 4 comprises at least one storage chamber 5 and at least one sealable cover 6. The at least one storage chamber 5 is designed to retain a beverage ingredient separate from the quantity of liquid within the container body 1 as well as the rest of beverage ingredients stored in other storage chambers. The at least one sealable cover 6 separates the stored beverage ingredient within the at least one storage chamber 5 from the quantity of liquid and the rest of beverage ingredients. To do so, the at least one storage chamber 5 is integrated within the storage base 4. The at least one sealable cover 6 is positioned coextensive with the at least one storage chamber 5 to prevent the undesired mixing of the retained beverage ingredient with the quantity of liquid and the rest of beverage ingredients. The at least one sealable cover 6 is also mounted within the storage base 4 so that the retained beverage ingredient is kept within the at least one storage chamber 5. To connect the storage base 4 to the container body 1, the storage base 4 is axially oriented with the container body 1. In addition, the storage base 4 is in fluid communication with the second open end 3. Thus, the container body 1 and the storage base 4 together form an overall elongated cylindrical structure. Further, the cap 15 is threadably engaged with the first open end 2 to releasably seal the container body 1. Furthermore, the additive dispensing mechanism 9 is operatively connected to the storage base 4 to enable the user to mix a quantity of the stored beverage ingredient within the at least one storage chamber 5 with the quantity of liquid retained within the container body 1. The additive dispensing mechanism 9 is used to selectively perforate the at least one sealable cover 6 to enable the mixing between the desired beverage ingredient and the quantity of liquid, thus making the desired custom beverage.

The additive dispensing mechanism 9 and the storage base 4 can be arranged in multiple configurations to facilitate the mixing of one or more beverage ingredients with the quantity of liquid. In a first one-step embodiment, the at least one sealable cover 6 is designed as a cylindrical structure that can be reused multiple times for continued use of the present invention. As can be seen in FIG. 5 through 11, to do so, the at least one sealable cover 6 may comprise a cover body 7 and at least one valve 8. The cover body 7 is designed to match the second open end 3 to connect the at least one sealable cover 6 to the container body 1. The at least one valve 8 enables the controlled mixing of the beverage ingredient within the at least one storage chamber 5 with the quantity of liquid within the container body 1. Further, to enable the controlled mixing of the beverage ingredients with the quantity of liquid, the additive dispensing mechanism 9 may comprise a bayonet connector 11. The bayonet connector 11 provides a mechanical way to manually control the mixing of the beverage ingredients with the quantity of liquid. To control the mixing of the beverage ingredients with the quantity of liquid, the at least one valve 8 is positioned coextensive with the at least one storage chamber 5 to cover the opening of the at least one storage chamber 5. The at least one valve 8 is also integrated into the cover body 7 so that the at least one valve 8 does not come loose after being opened. The cover body 7 is positioned concentric with the storage base 4 so that the overall assembly is an elongated cylindrical structure. The cover body 7 is threadably engaged with the second open end 3 to connect the cover body 7 to the container body 1. Further, the storage base 4 is rotatably connected with the cover body 7 by the bayonet connector 11. This way, the user rotates and pushes the storage base 4 to engage the additive dispensing mechanism 9, which opens the at least one valve 8 to enable the mixing of the beverage ingredients with the quantity of liquid.

To control when the beverage ingredient is to be mixed with the quantity of liquid, the additive dispensing mechanism 9 may further comprise at least one perforator 14. As can be seen in FIG. 5 through 11, the at least one perforator 14 is an elongated thin protrusion that is pressed against the at least one valve 8 to open the at least one valve 8. To do so, the at least one perforator 14 is positioned geometrical normal to the storage base 4. This way, when the at least one perforator 14 is pressed against the at least one valve 8, the at least one perforator 14 punctures the at least one valve 8 to enable the mixing of the beverage ingredient with the quantity of liquid. In addition, the at least one perforator 14 is mounted within the at least one storage chamber 5 so that only the desired at least one valve 8 is opened to enable the mixing of the quantity of liquid with the desired beverage ingredients.

Figure 12:
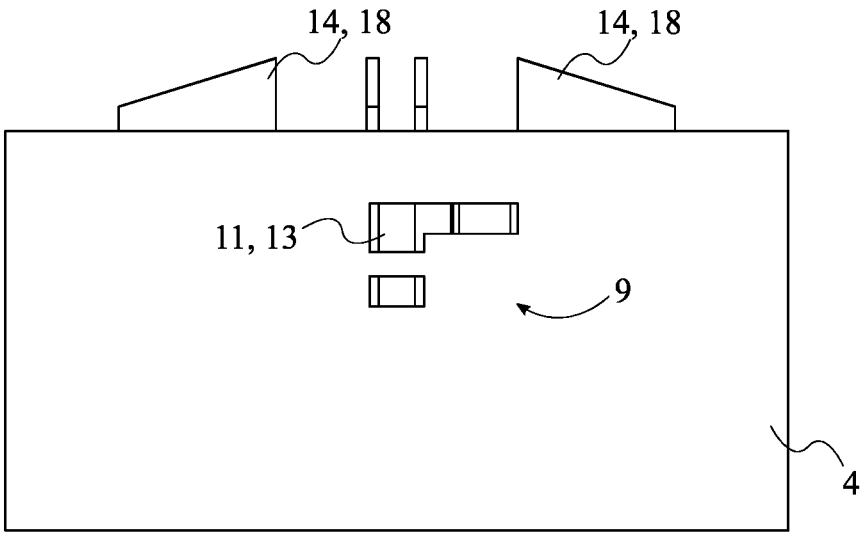
FIG. 12 is a front view showing the storage base of the first one-step embodiment of the present invention, wherein the storage base is shown with multiple perforators.
Figure 13:
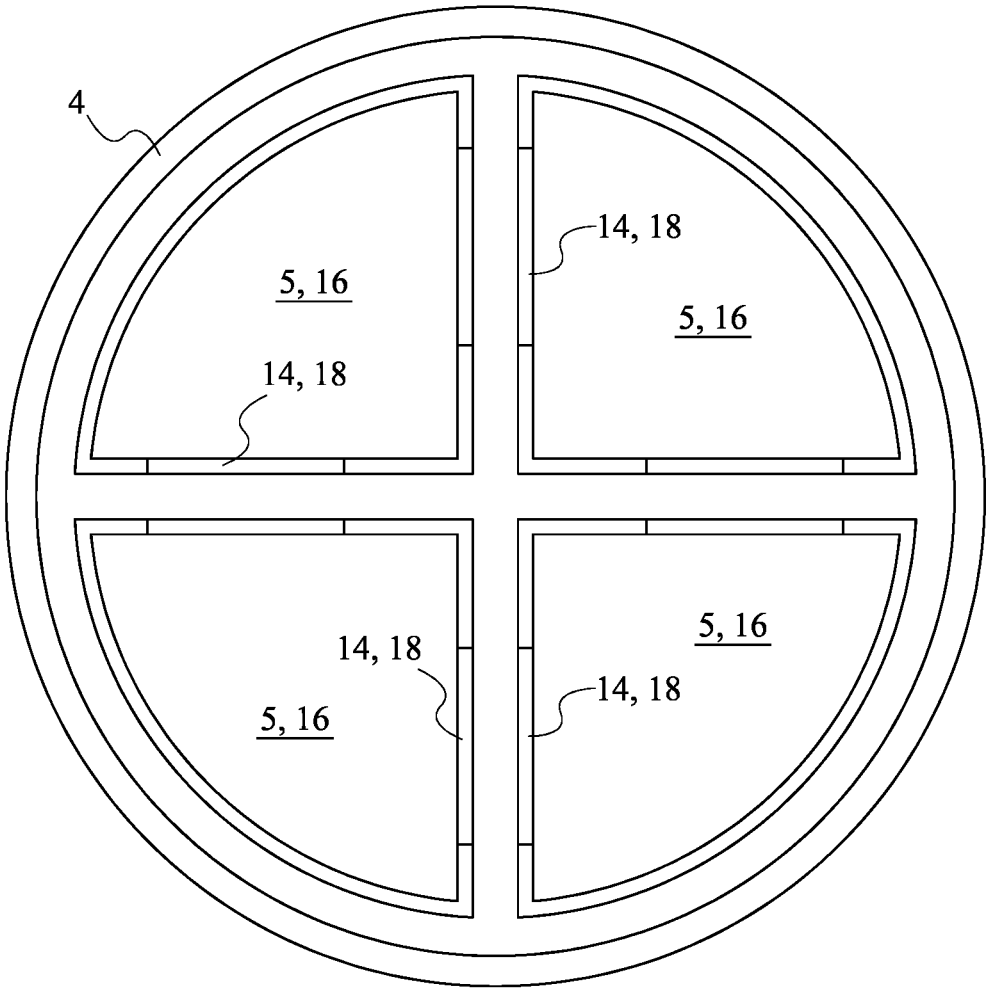
FIG. 13 is a top view showing the storage base of the first one-step embodiment of the present invention, wherein the storage base is shown with multiple storage chambers and multiple perforators.
Figure 14:
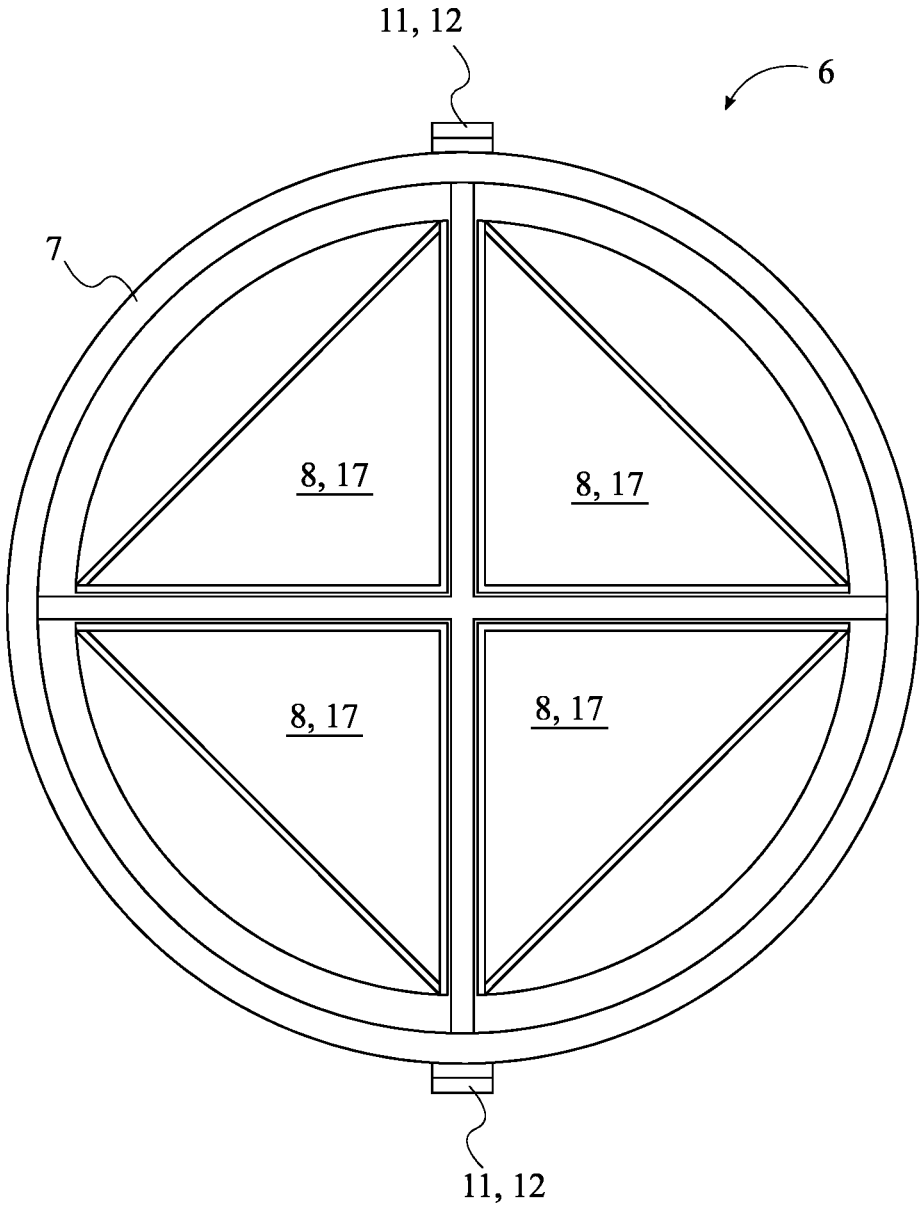
FIG. 14 is a top view showing the sealable cover of the first one-step embodiment of the present invention, wherein the sealable cover is shown with multiple valves.
Figure 15:
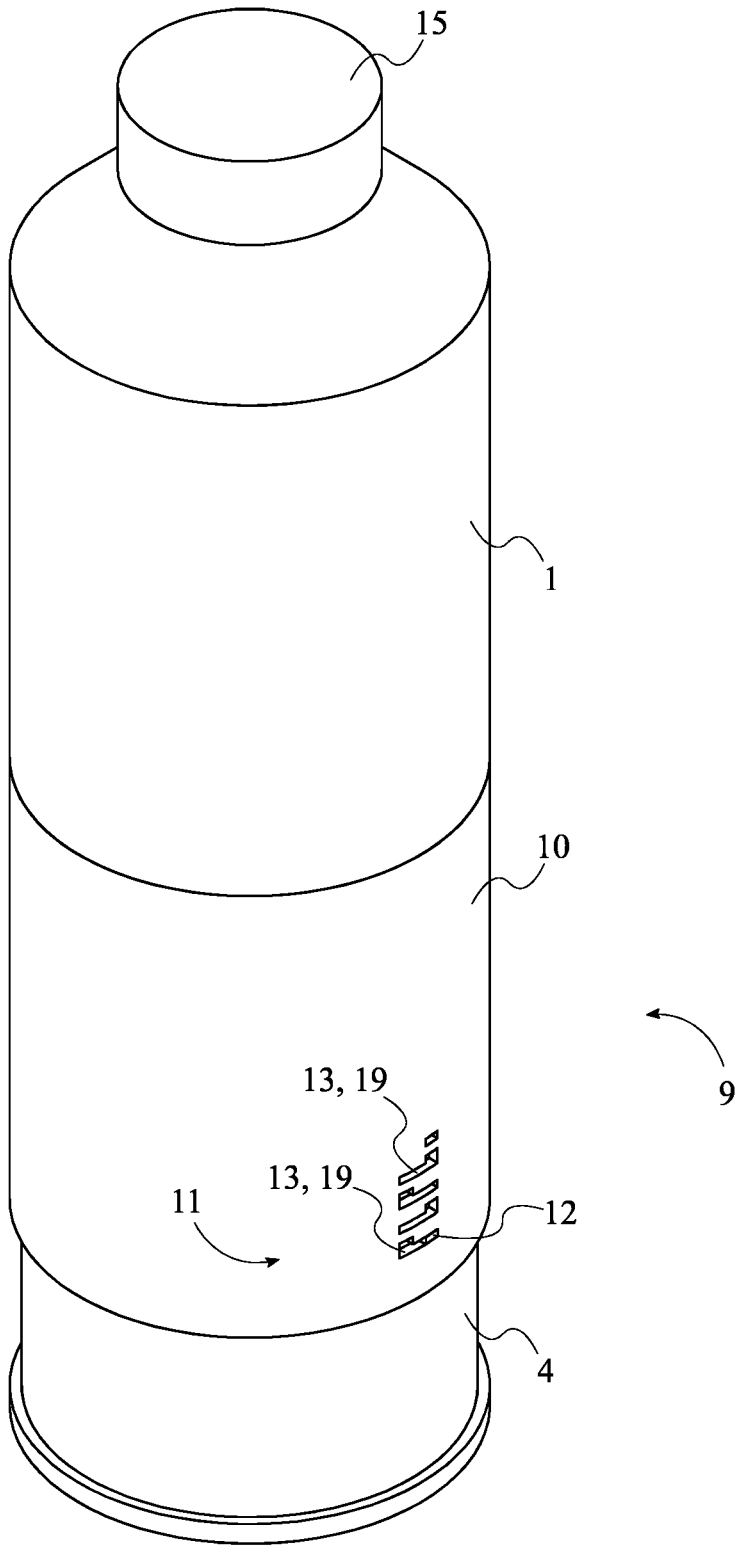
FIG. 15 is a top-front perspective view showing the multi-step embodiment of the present invention.
Figure 16:
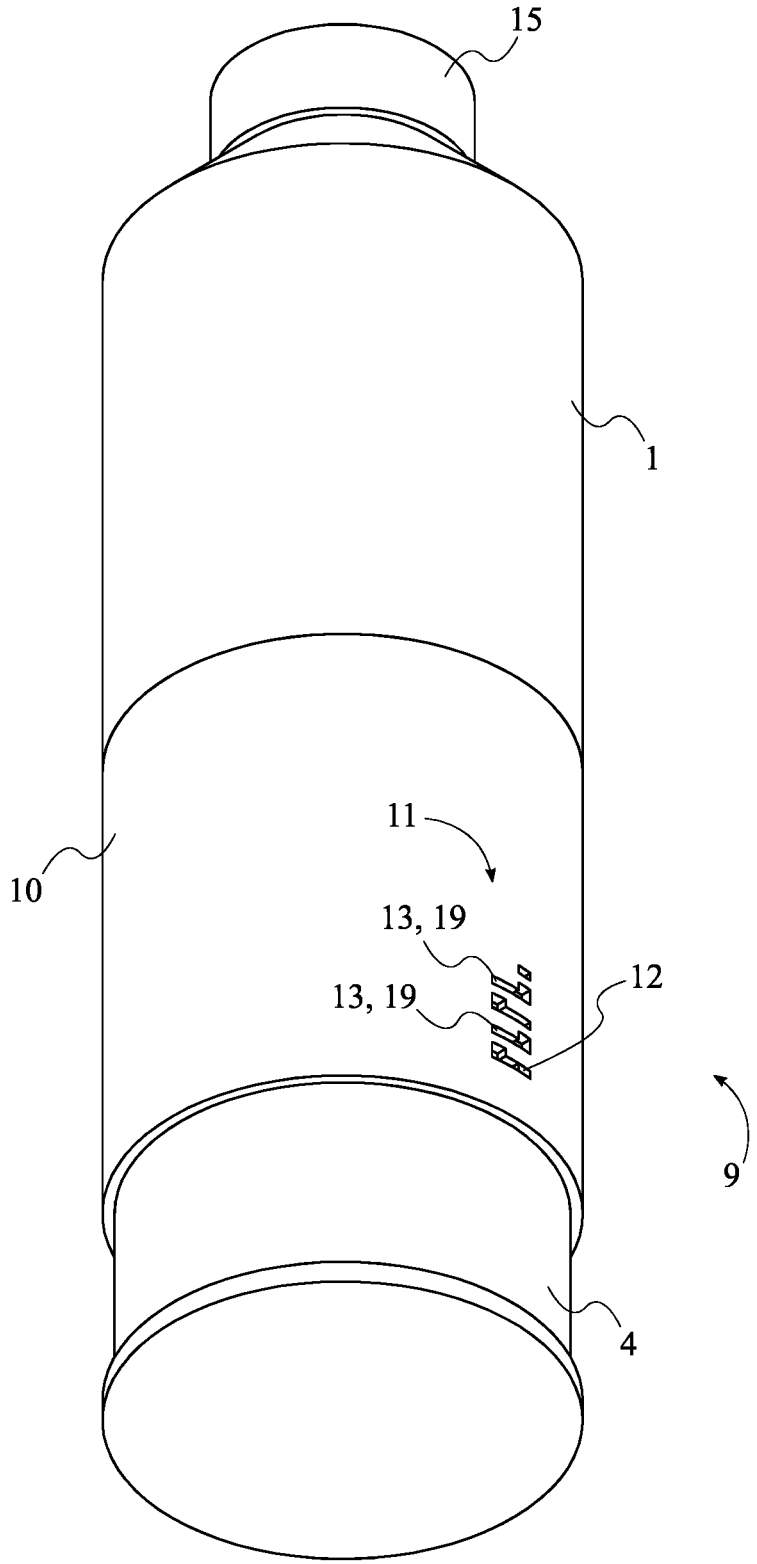
FIG. 16 is a bottom-rear perspective view showing the multi-step embodiment of the present invention.
Figure 17:
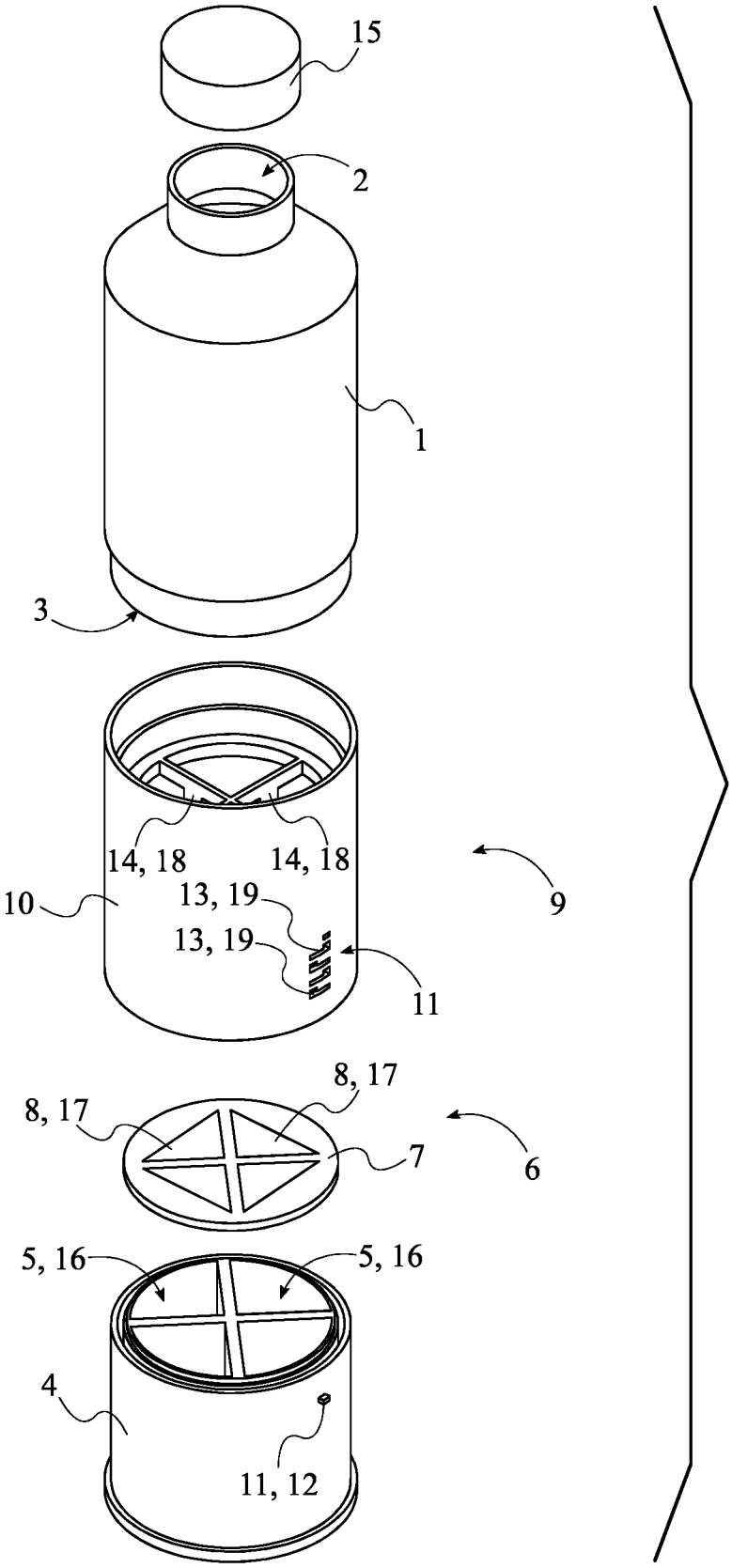
FIG. 17 is a top-front-exploded perspective view showing the multi-step embodiment of the present invention.
Figure 18:
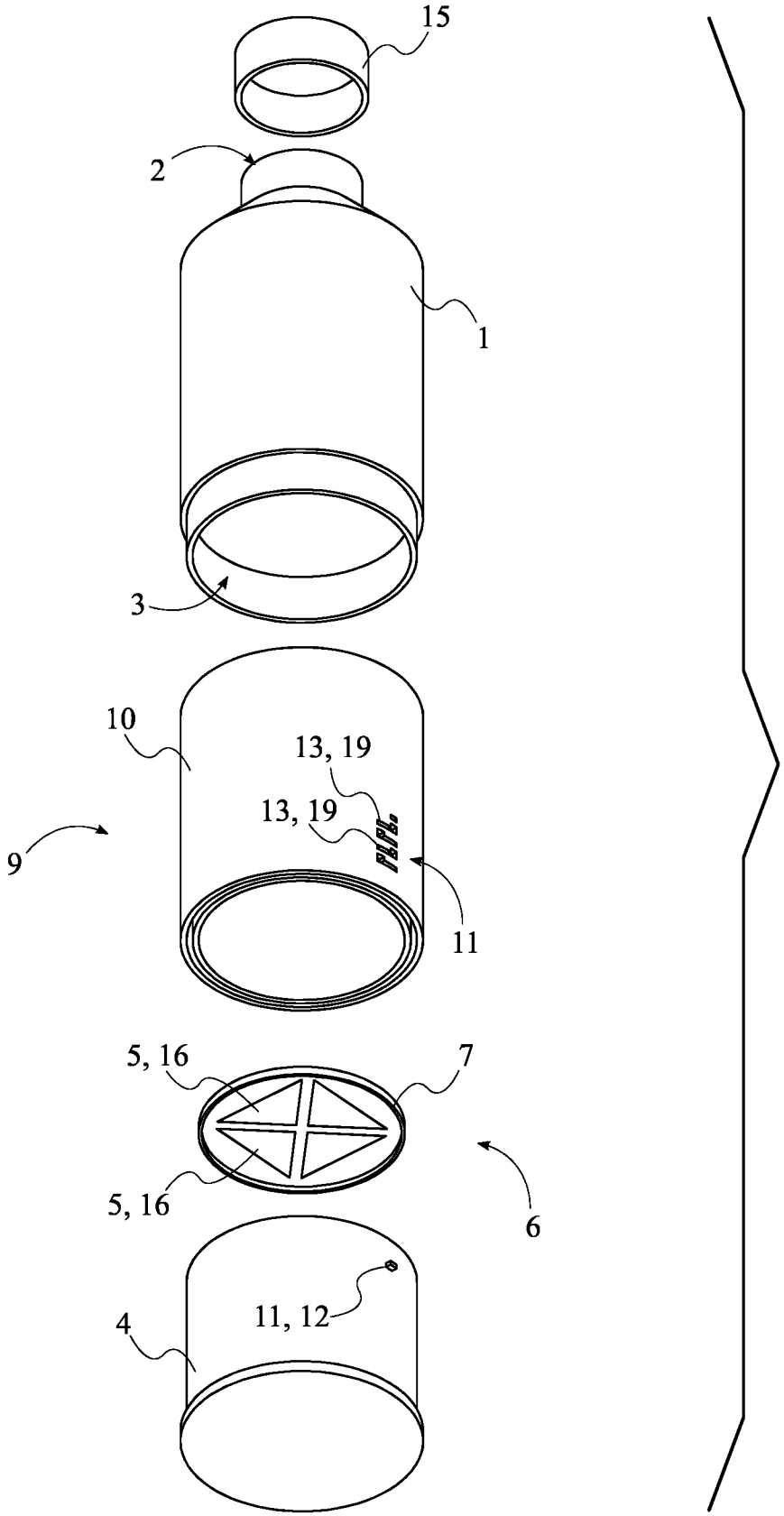
FIG. 18 is a bottom-rear-exploded perspective view showing the multi-step embodiment of the present invention.
Figure 19:
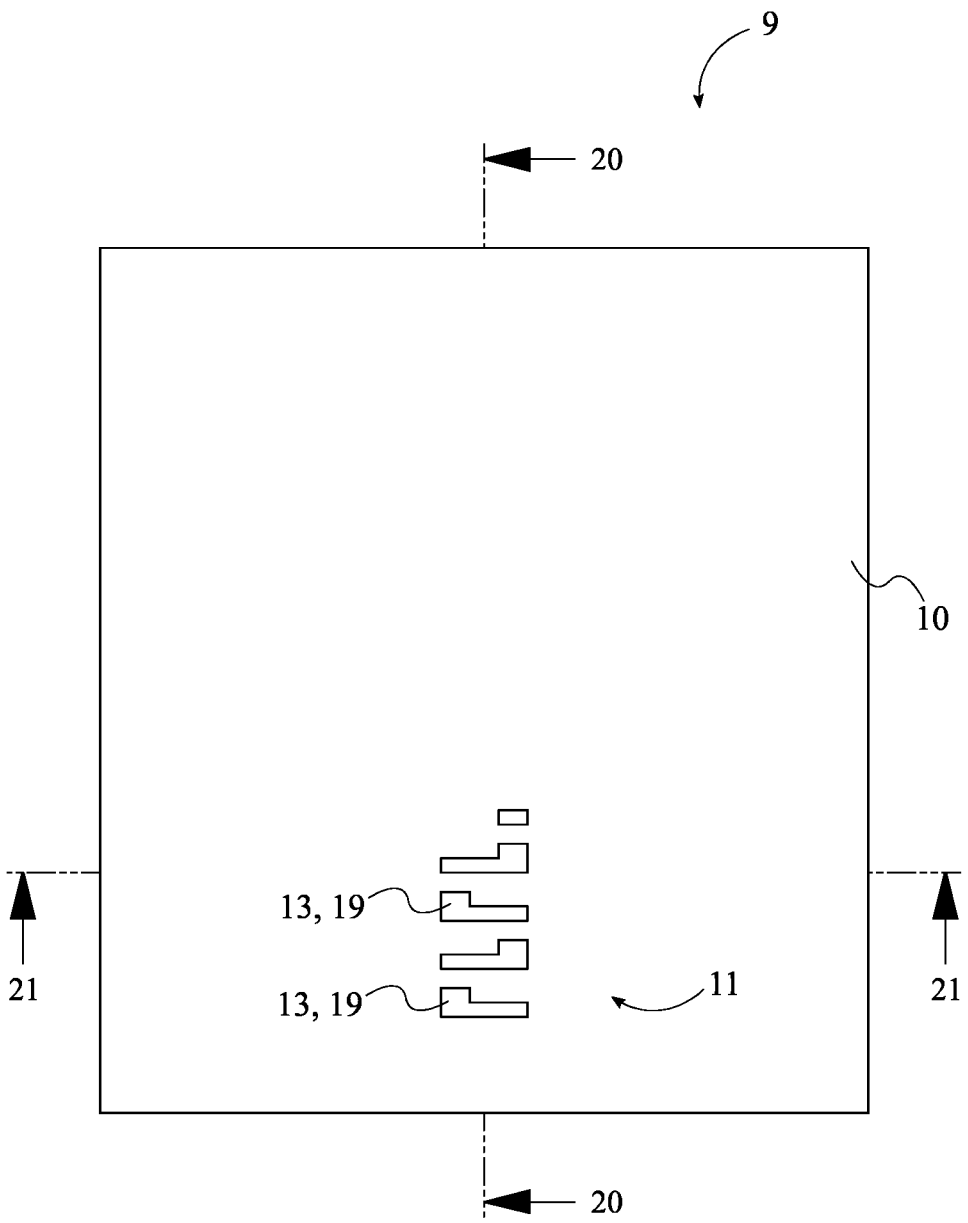
FIG. 19 is a front view of the collar of the multi-step embodiment of the present invention.
Figure 20:
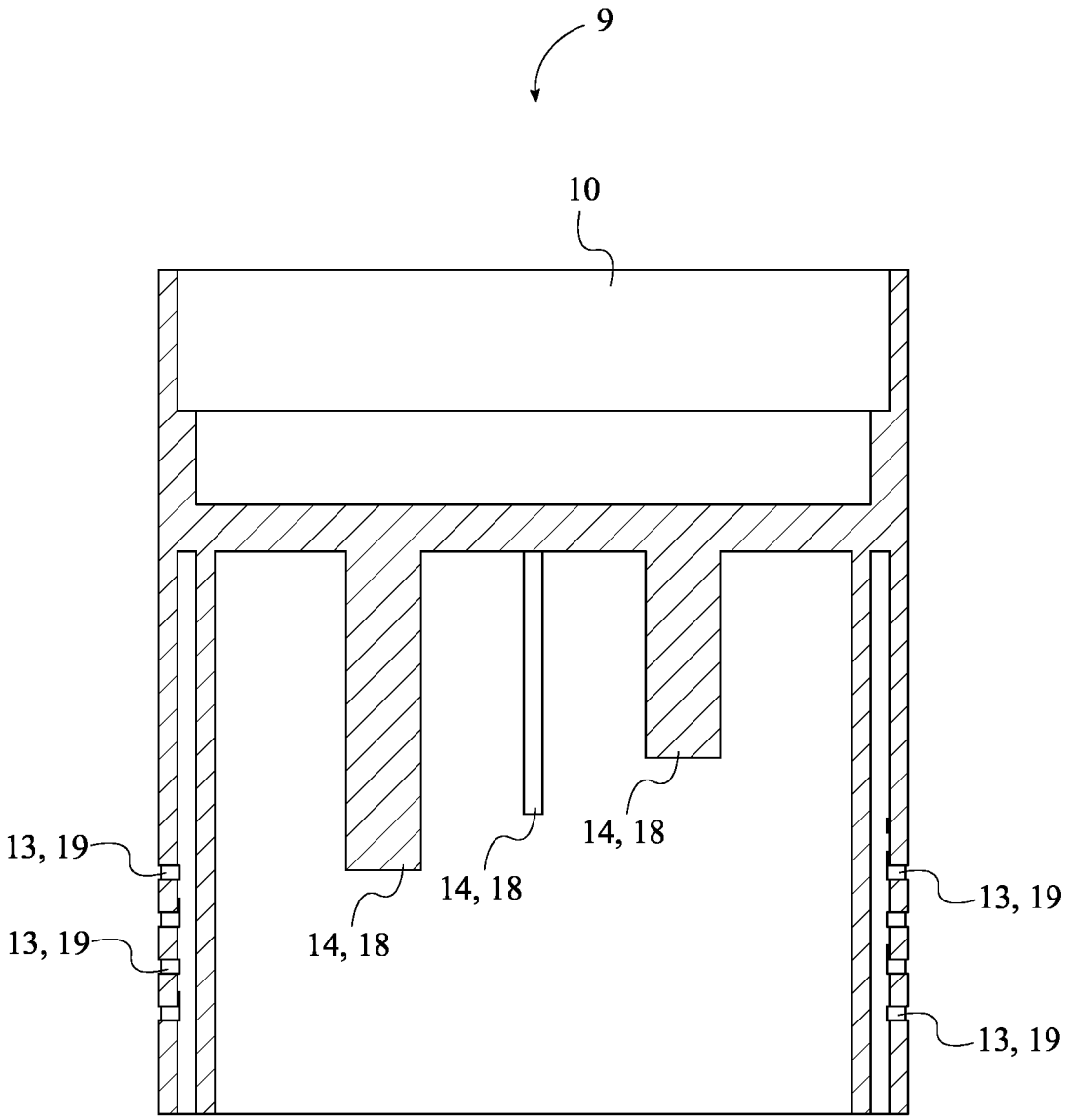
FIG. 20 is a vertical cross-sectional view of the collar of the multi-step embodiment of the present invention taken in the direction of line 20-20 in FIG. 19.
Figure 21:
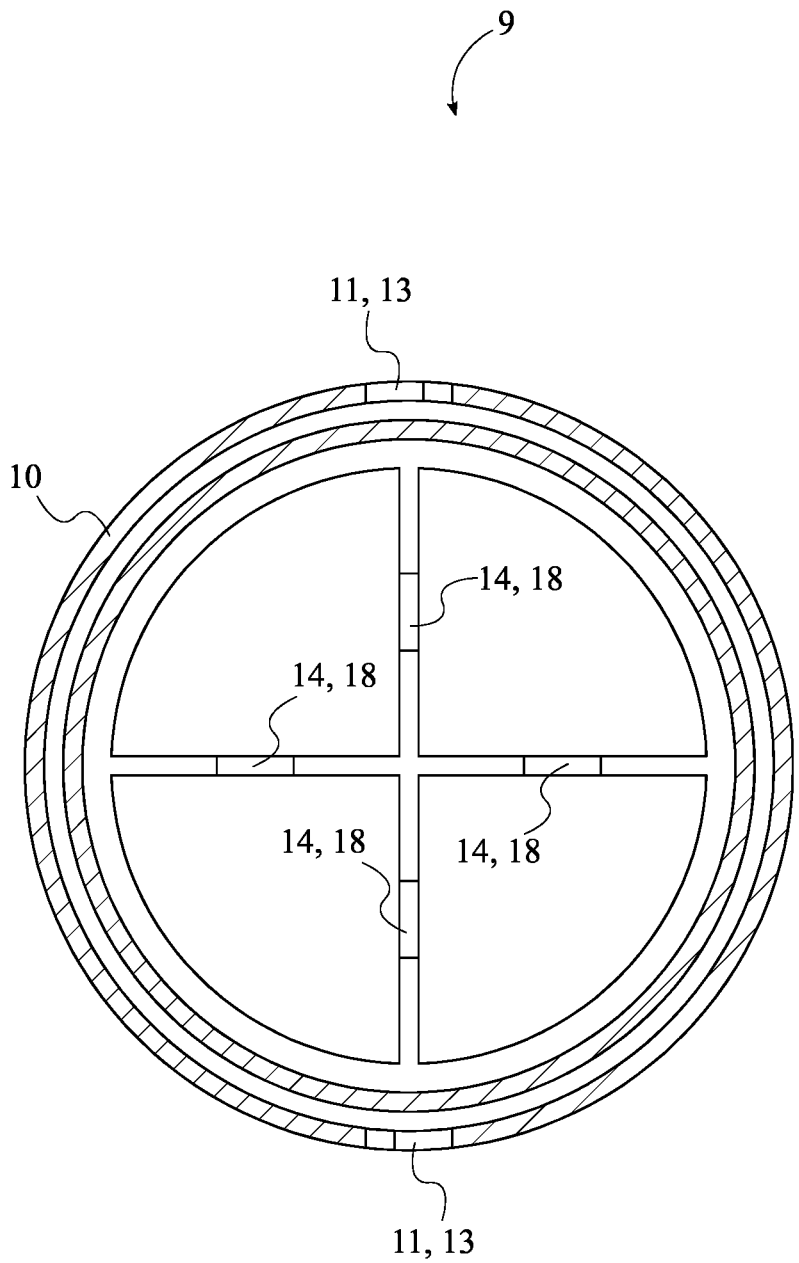
FIG. 21 is a horizontal cross-sectional view of the collar of the multi-step embodiment of the present invention taken in the direction of line 21-21 in FIG. 19.
Figure 22:
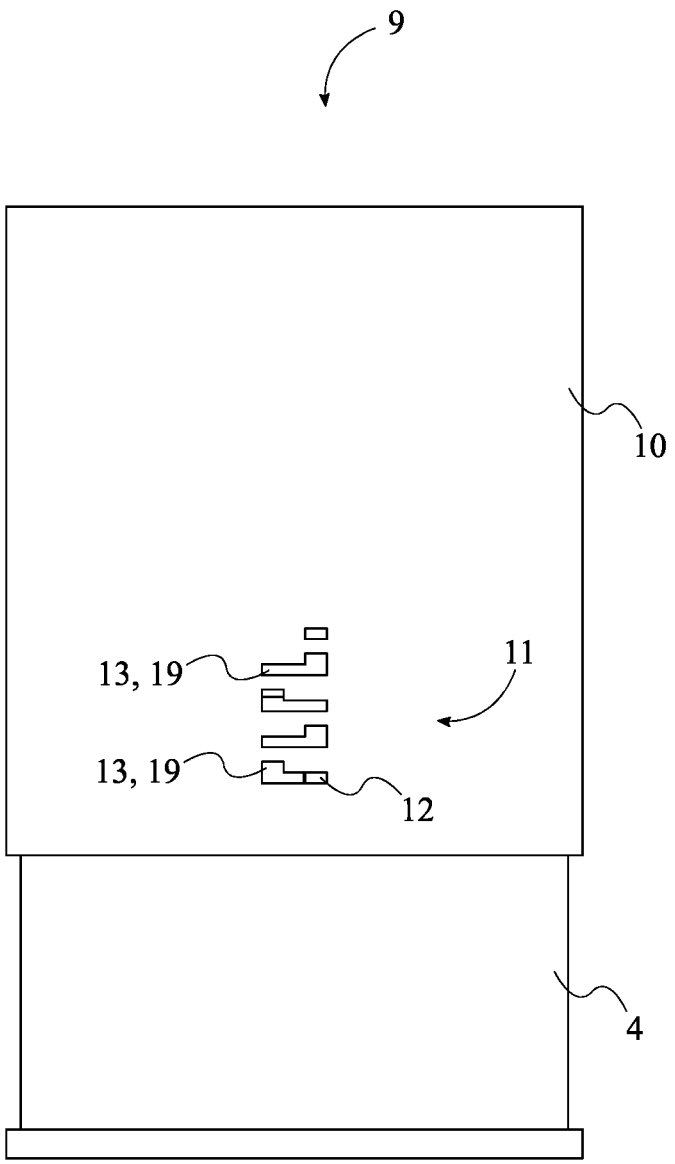
FIG. 22 is a front view of the collar and the storage base of the multi-step embodiment of the present invention.
Figure 23:
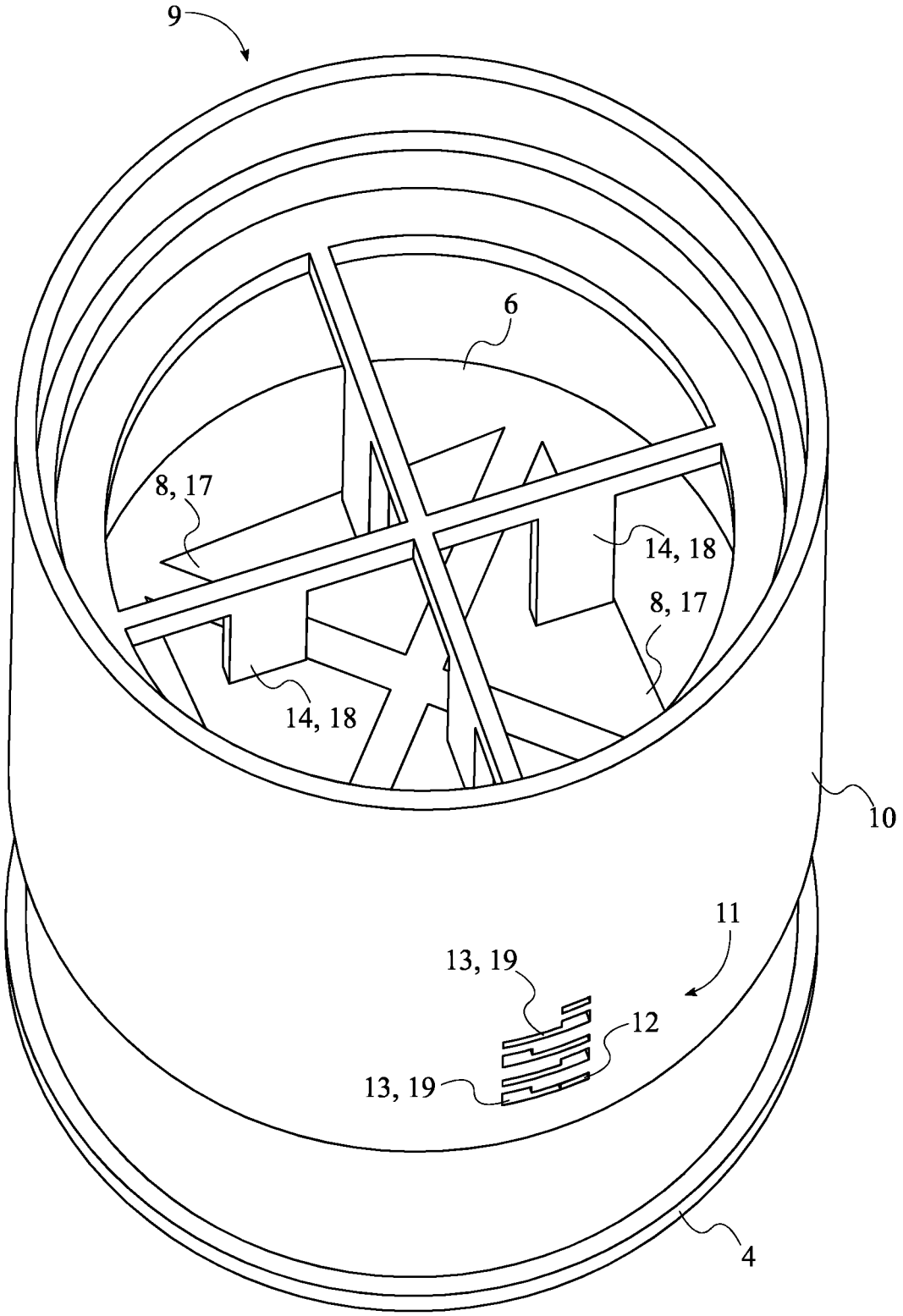
FIG. 23 is a top-front perspective view of the collar and the storage base of the multi-step embodiment of the present invention.
Figure 24:
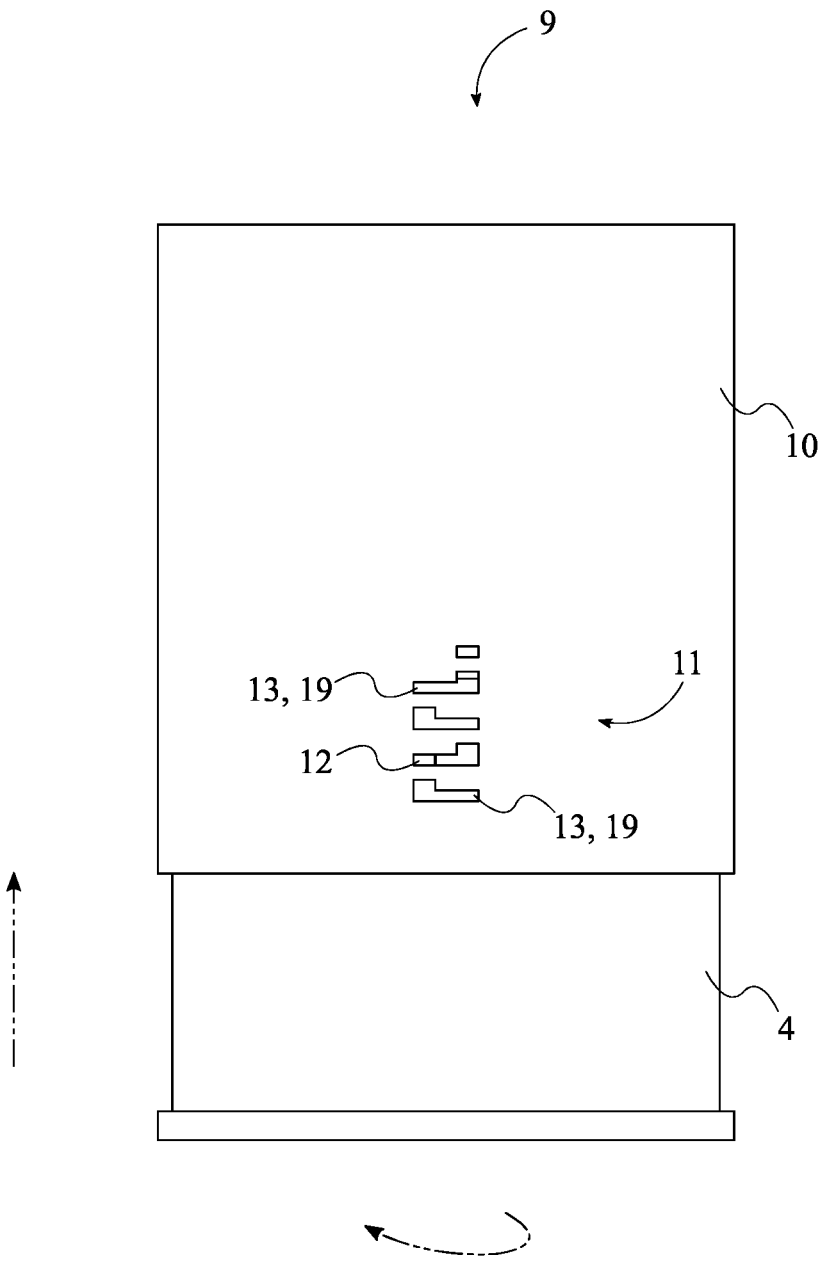
FIG. 24 is a front view of the collar and the storage base of the multi-step embodiment of the present invention, wherein the storage base is shown rotated clockwise and pushed into the collar.
Figure 25:
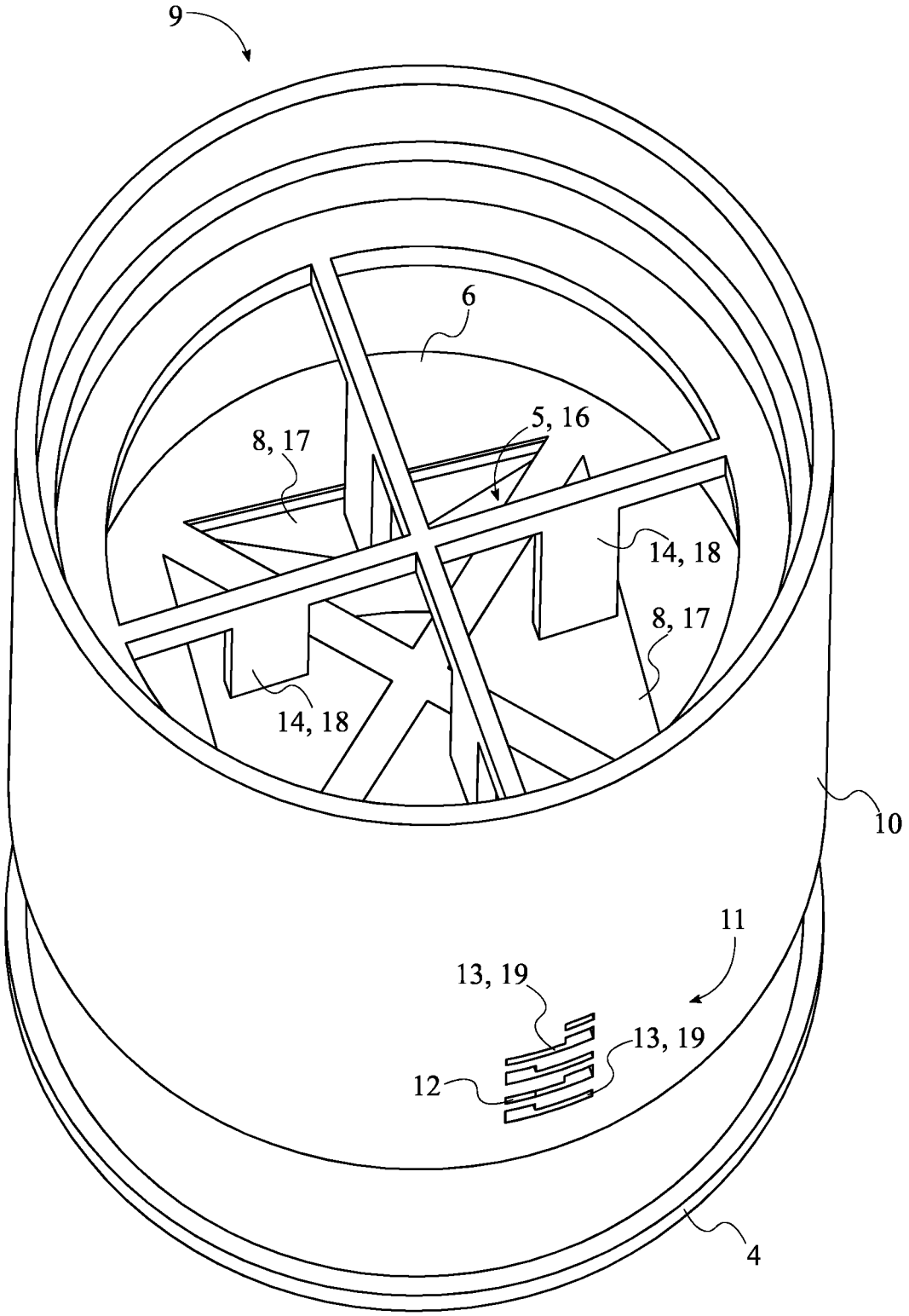
FIG. 25 is a top-front perspective view of the collar and the storage base of the multi-step embodiment of the present invention, wherein a first storage chamber is shown unsealed by a first perforator.
Figure 26:
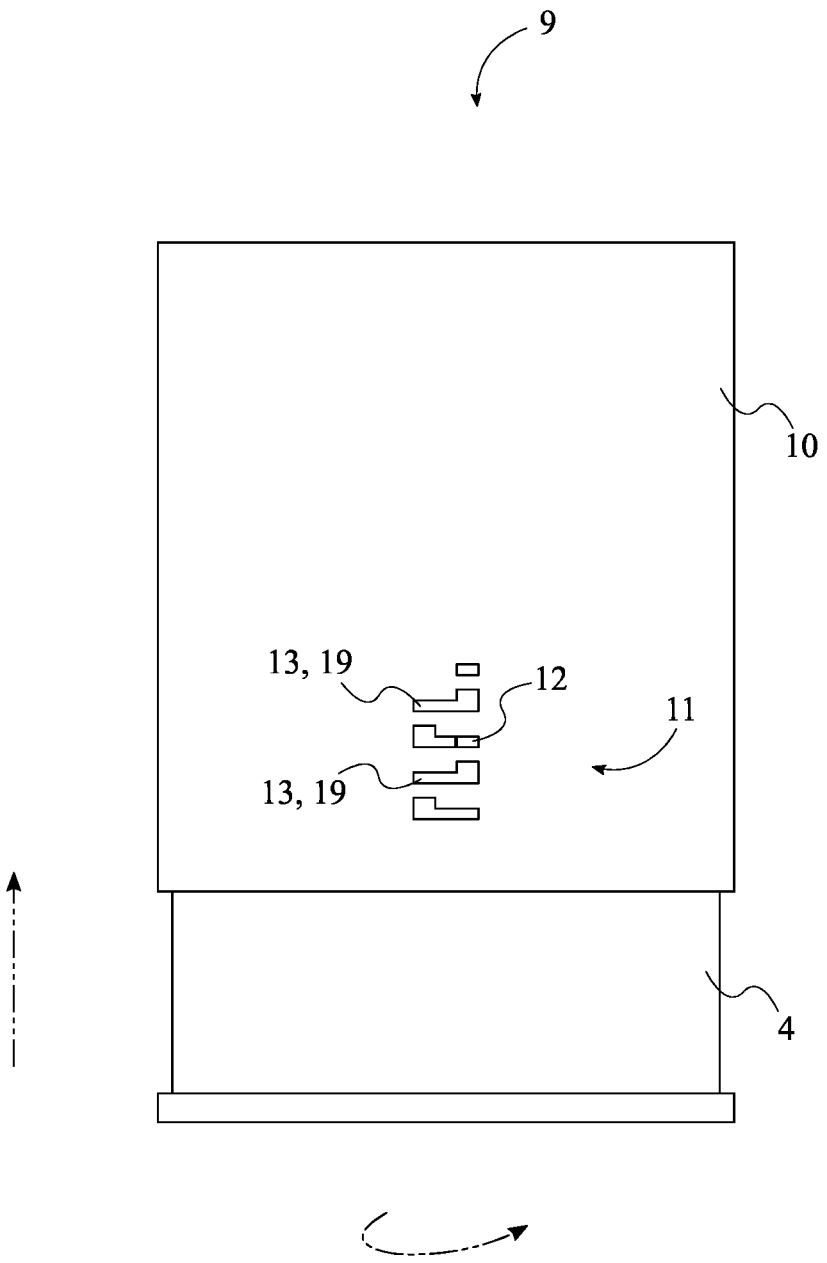
FIG. 26 is a front view of the collar and the storage base of the multi-step embodiment of the present invention, wherein the storage base is shown rotated counterclockwise and pushed further into the collar.
Figure 27:
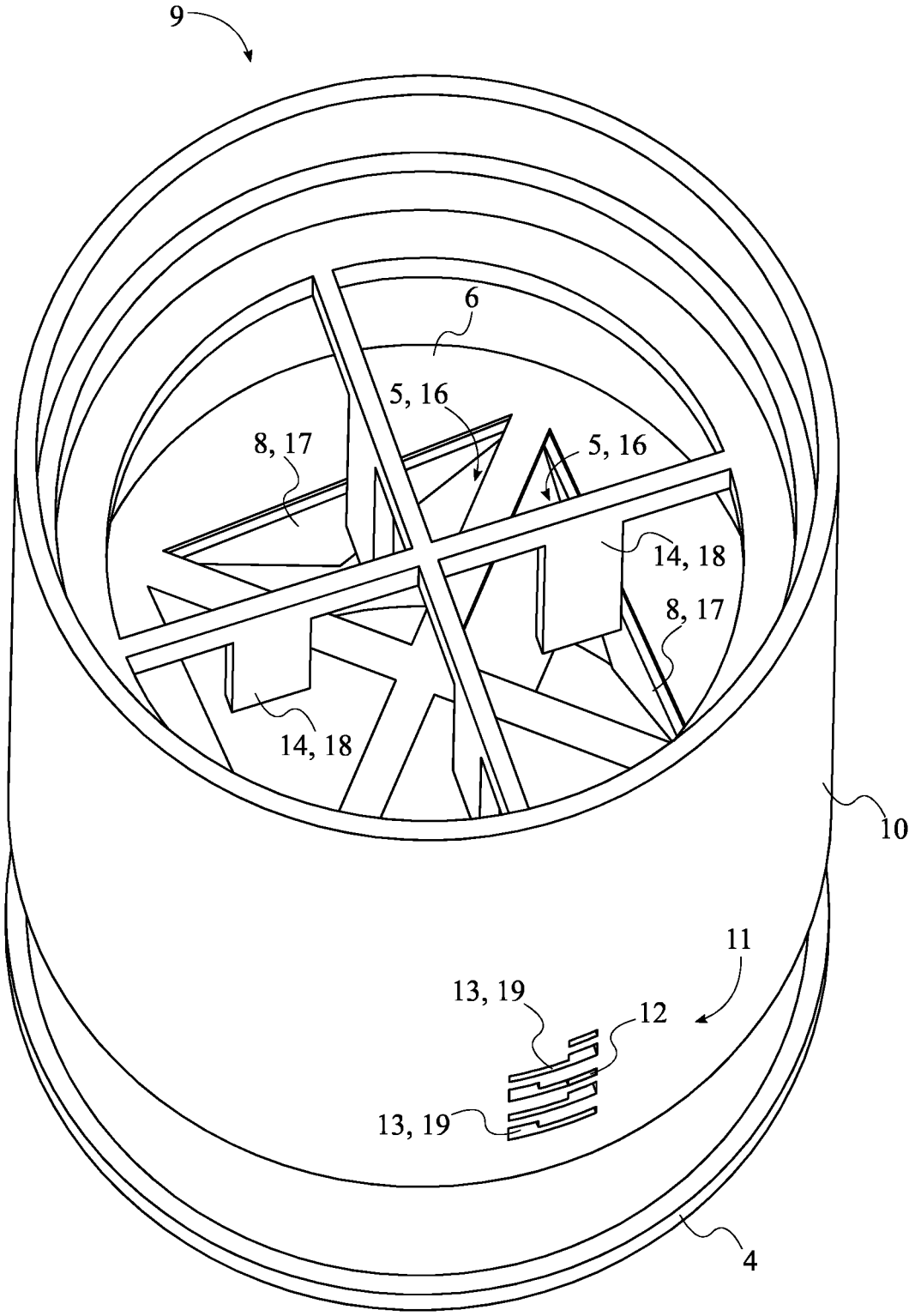
FIG. 27 is a top-front perspective view of the collar and the storage base of the multi-step embodiment of the present invention, wherein a second storage chamber is shown unsealed by a second perforator.
Figure 28:
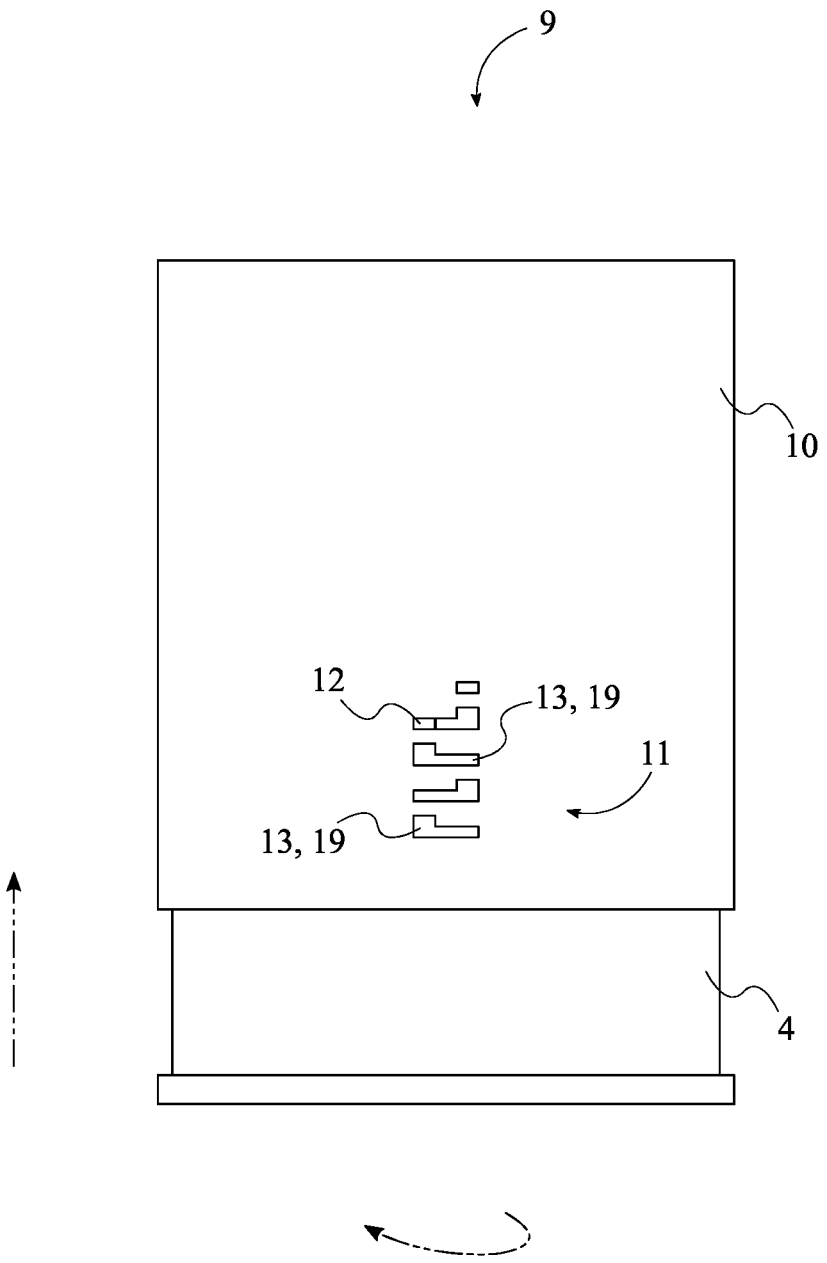
FIG. 28 is a front view of the collar and the storage base of the multi-step embodiment of the present invention, wherein the storage base is shown rotated clockwise and pushed further into the collar.
Figure 29:
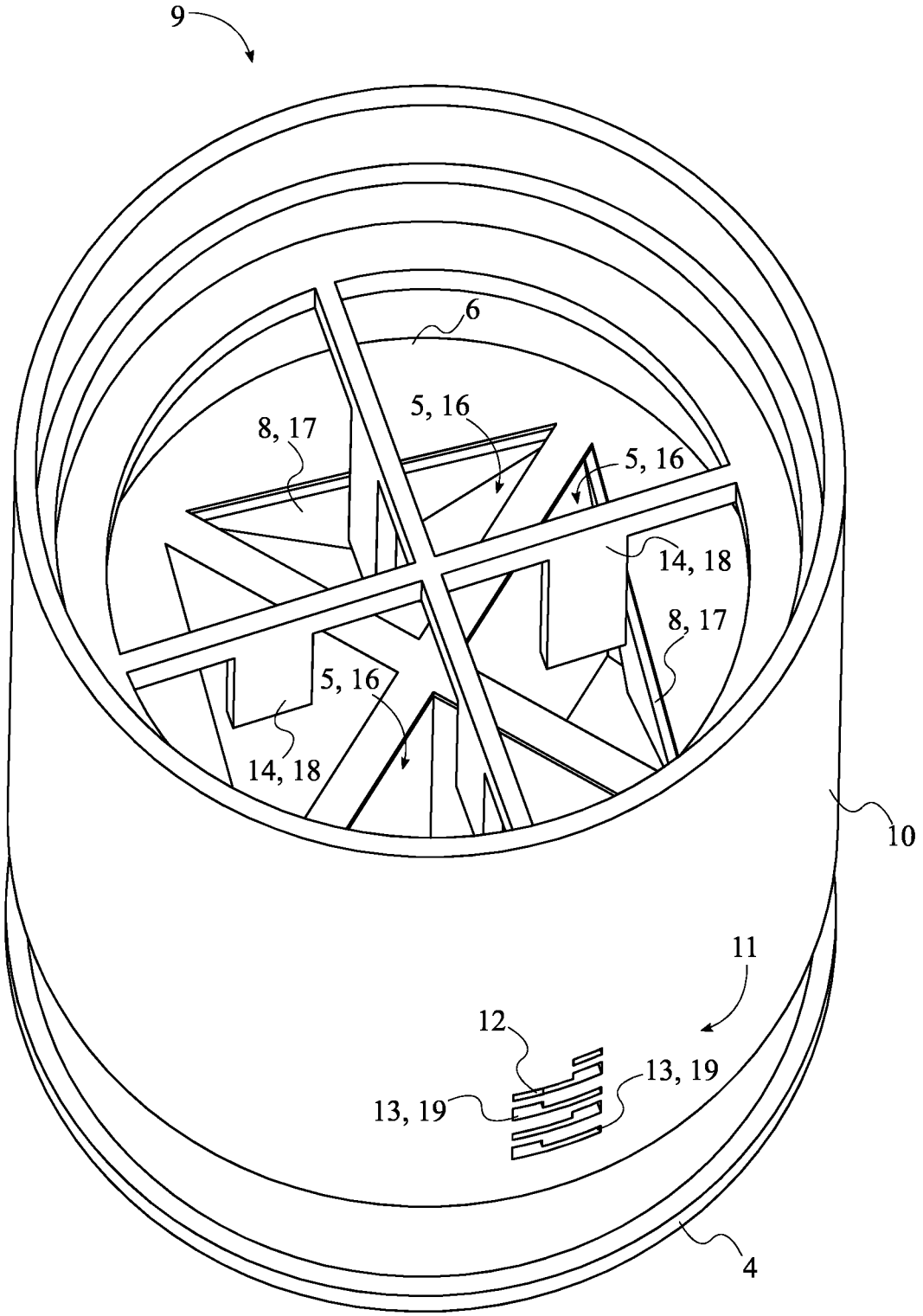
FIG. 29 is a top-front perspective view of the collar and the storage base of the multi-step embodiment of the present invention, wherein a third storage chamber is shown unsealed by a third perforator.
Figure 30:
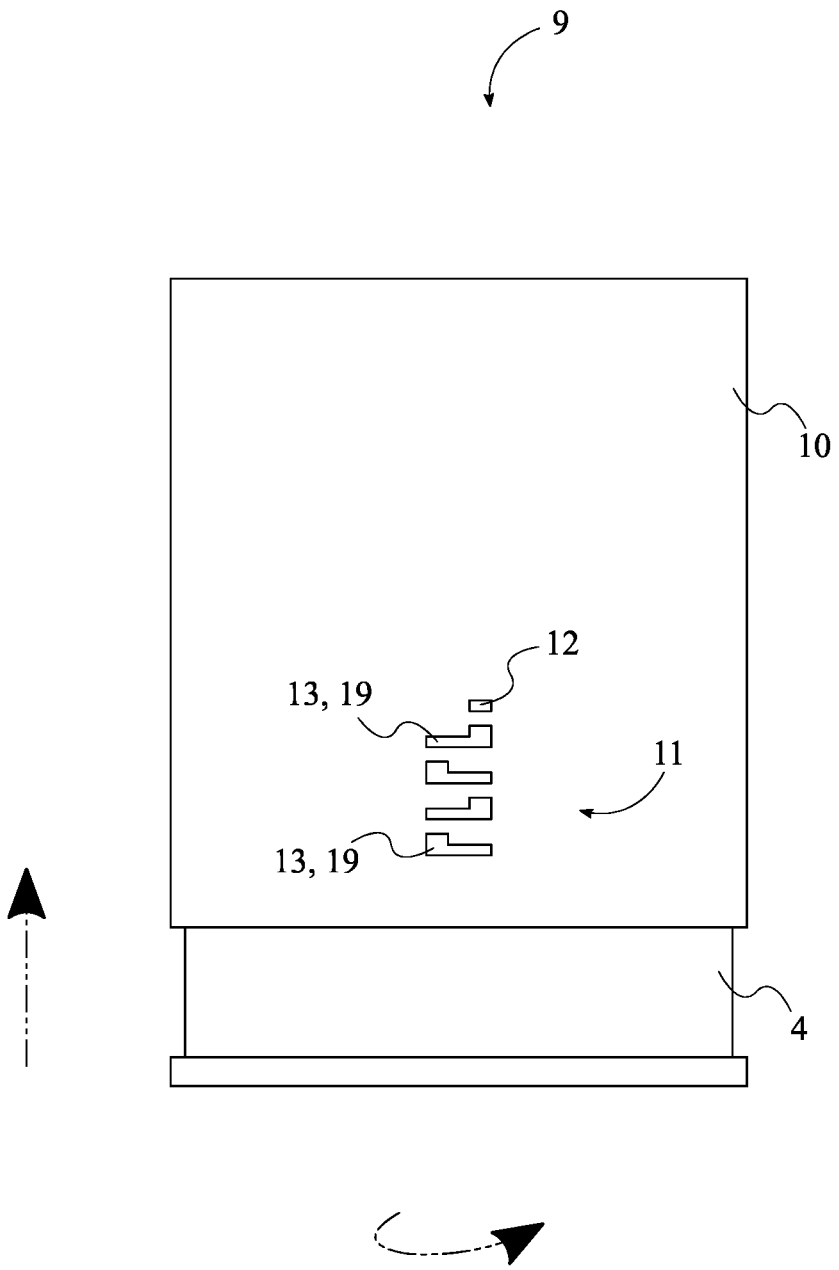
FIG. 30 is a front view of the collar and the storage base of the multi-step embodiment of the present invention, wherein the storage base is shown rotated counterclockwise and pushed further into the collar.
Figure 31:
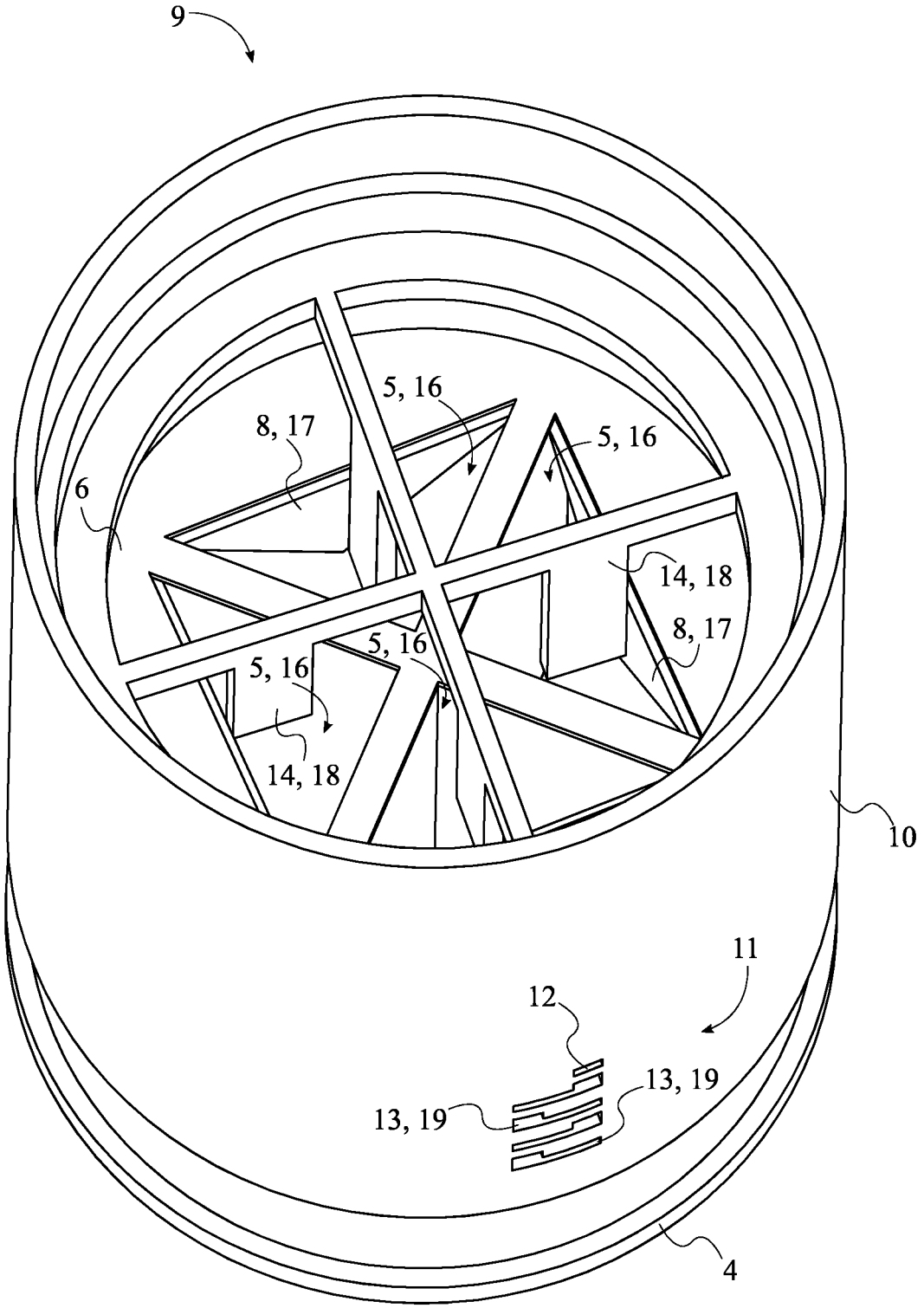
FIG. 31 is a top-front perspective view of the collar and the storage base of the multi-step embodiment of the present invention, wherein a fourth storage chamber is shown unsealed by a fourth perforator.
Figure 32:
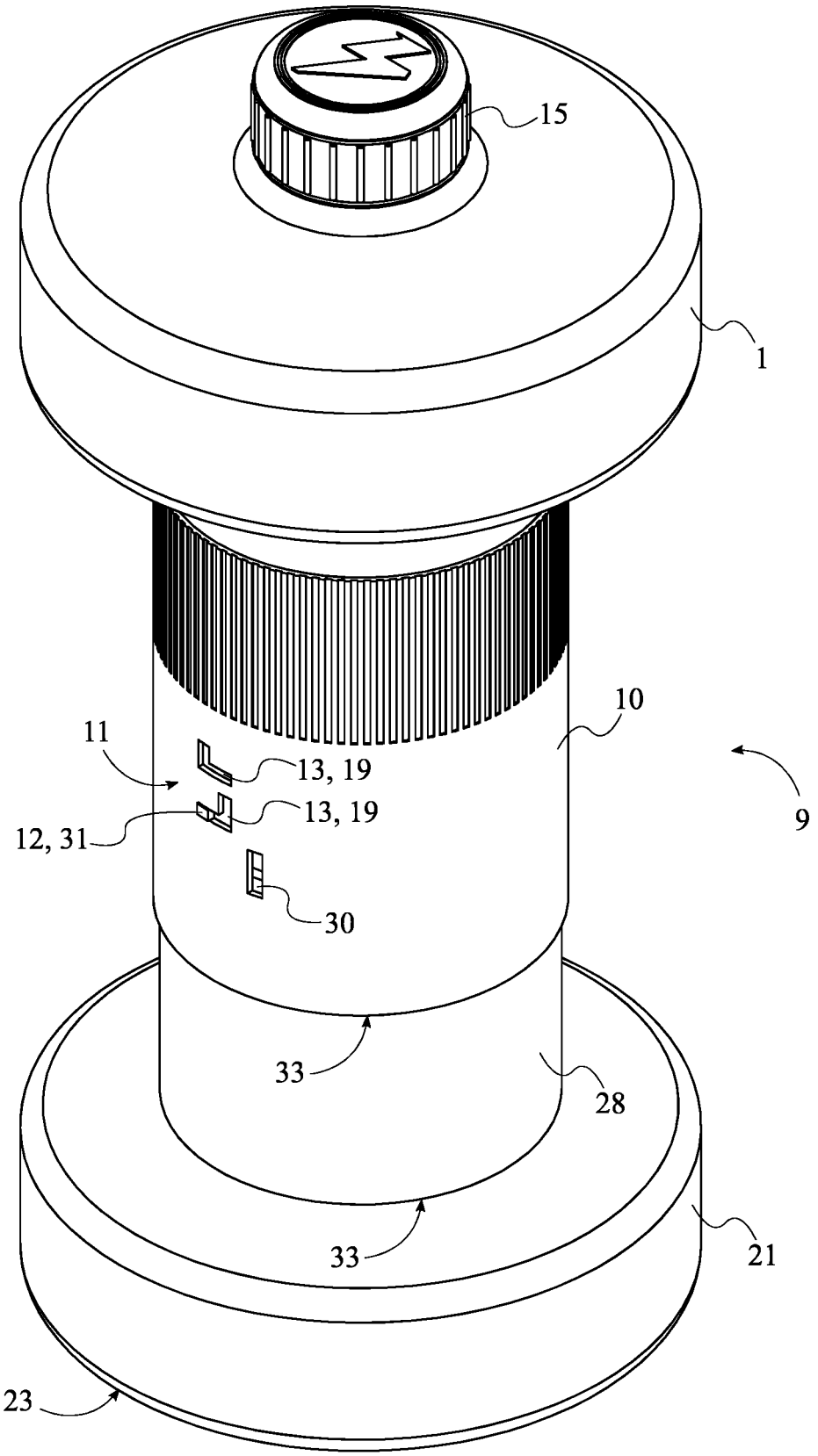
FIG. 32 is a top-front perspective view of a double-container embodiment of the present invention.
Figure 33:
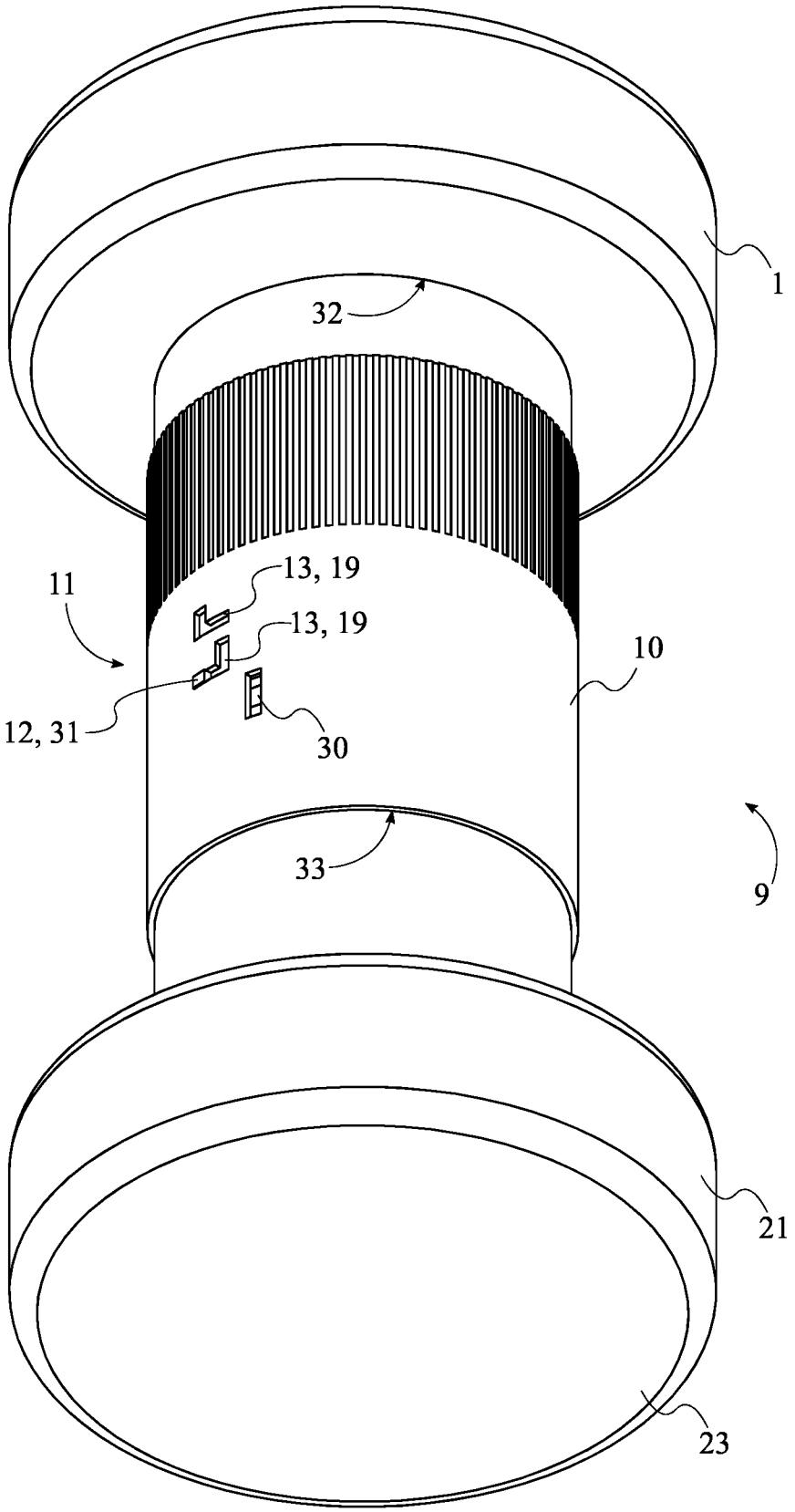
FIG. 33 is a bottom rear perspective view of the double-container embodiment of the present invention.
Figure 34:
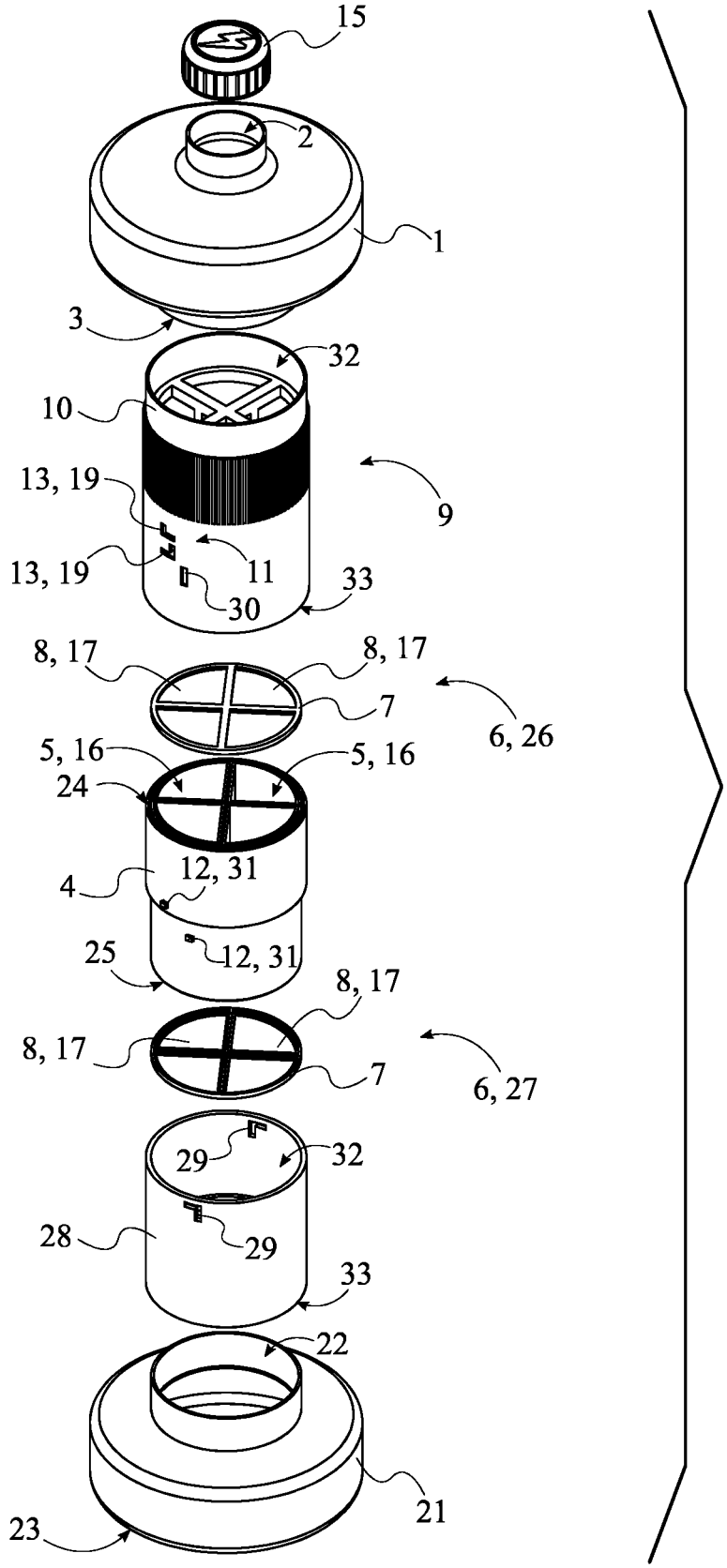
FIG. 34 is a top-front exploded perspective view of a double-container embodiment of the present invention.
Figure 35:
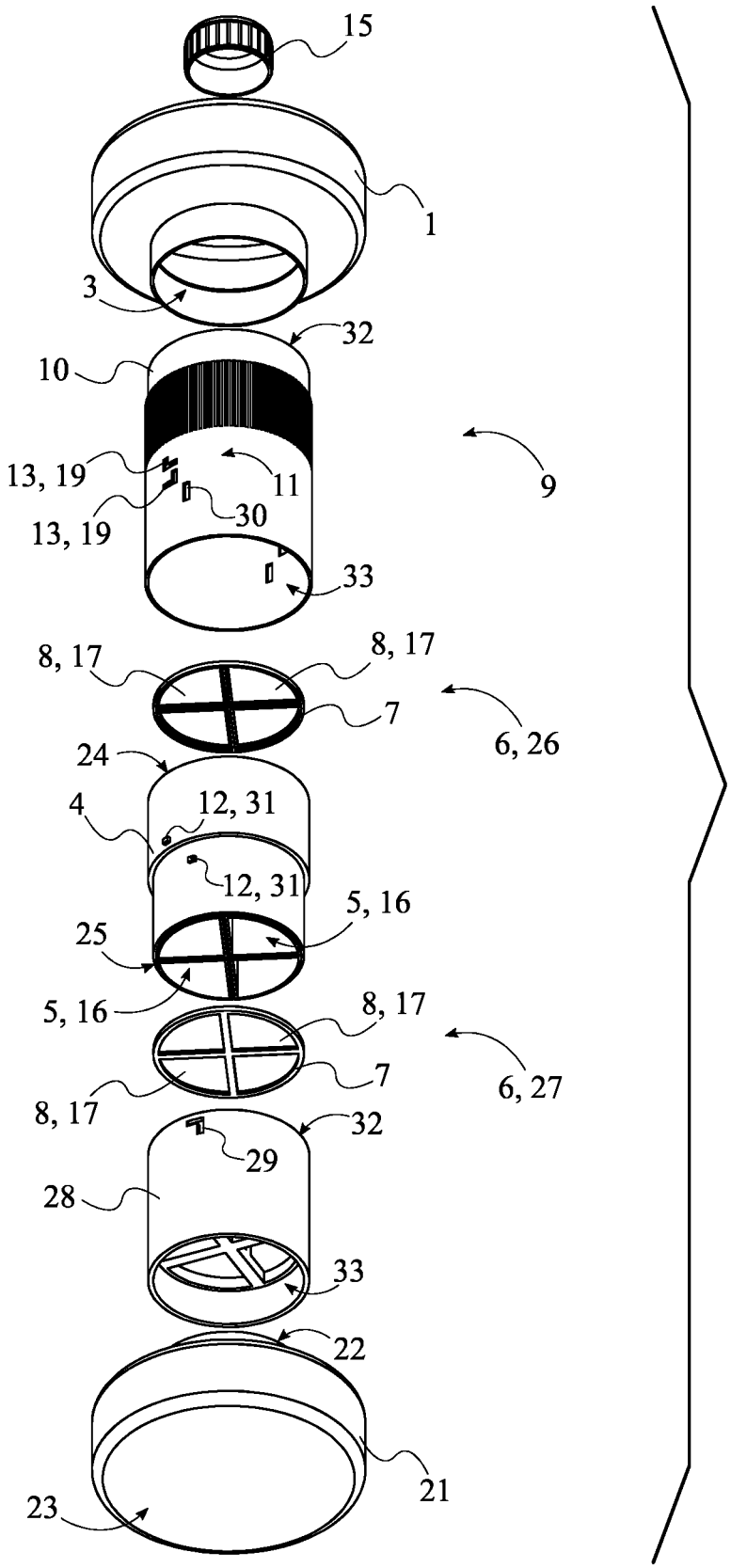
FIG. 35 is a bottom-rear exploded perspective view of the double-container embodiment of the present invention.
Figure 36:
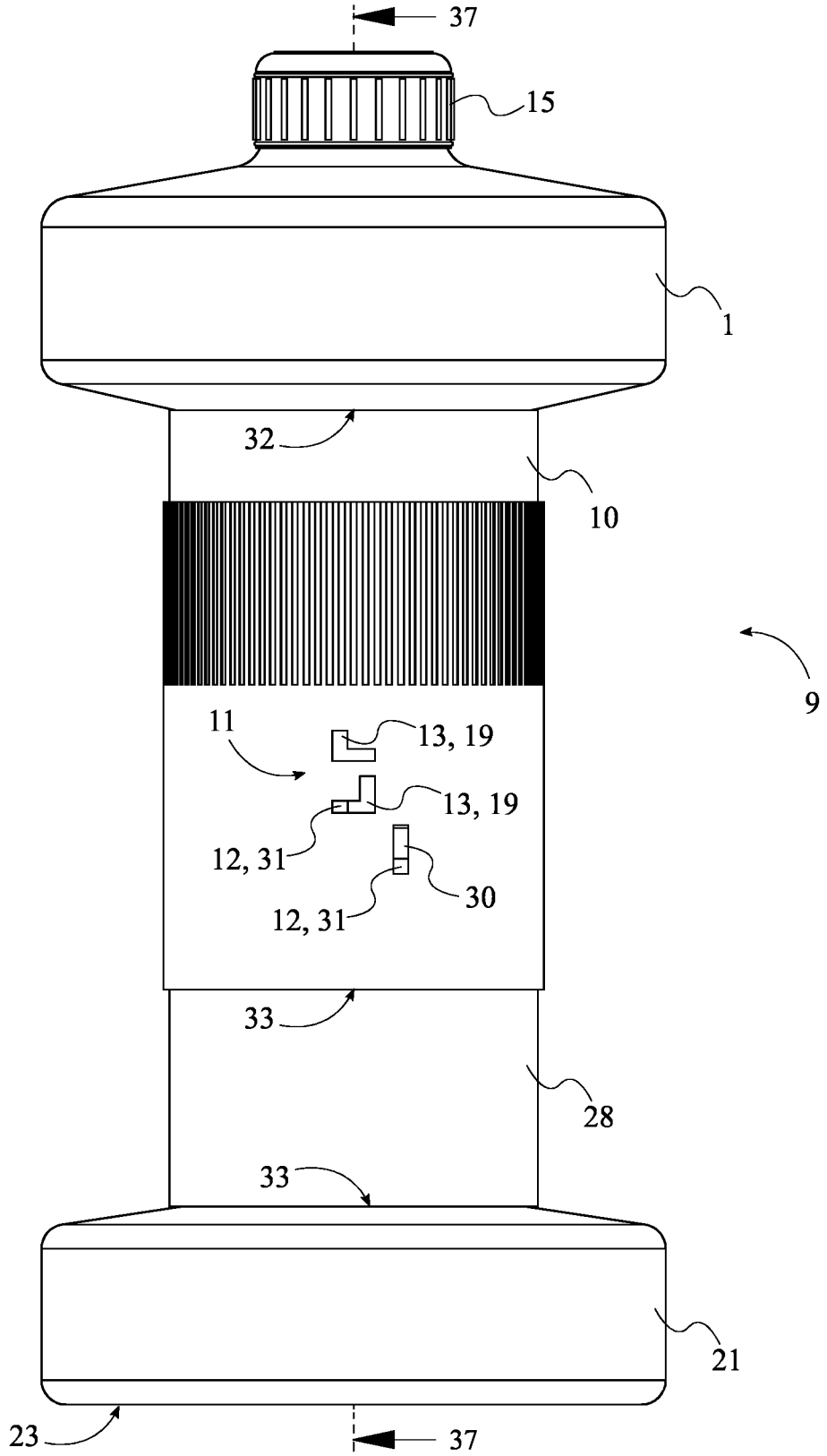
FIG. 36 is a front view of the double-container embodiment of the present invention.
Figure 37:
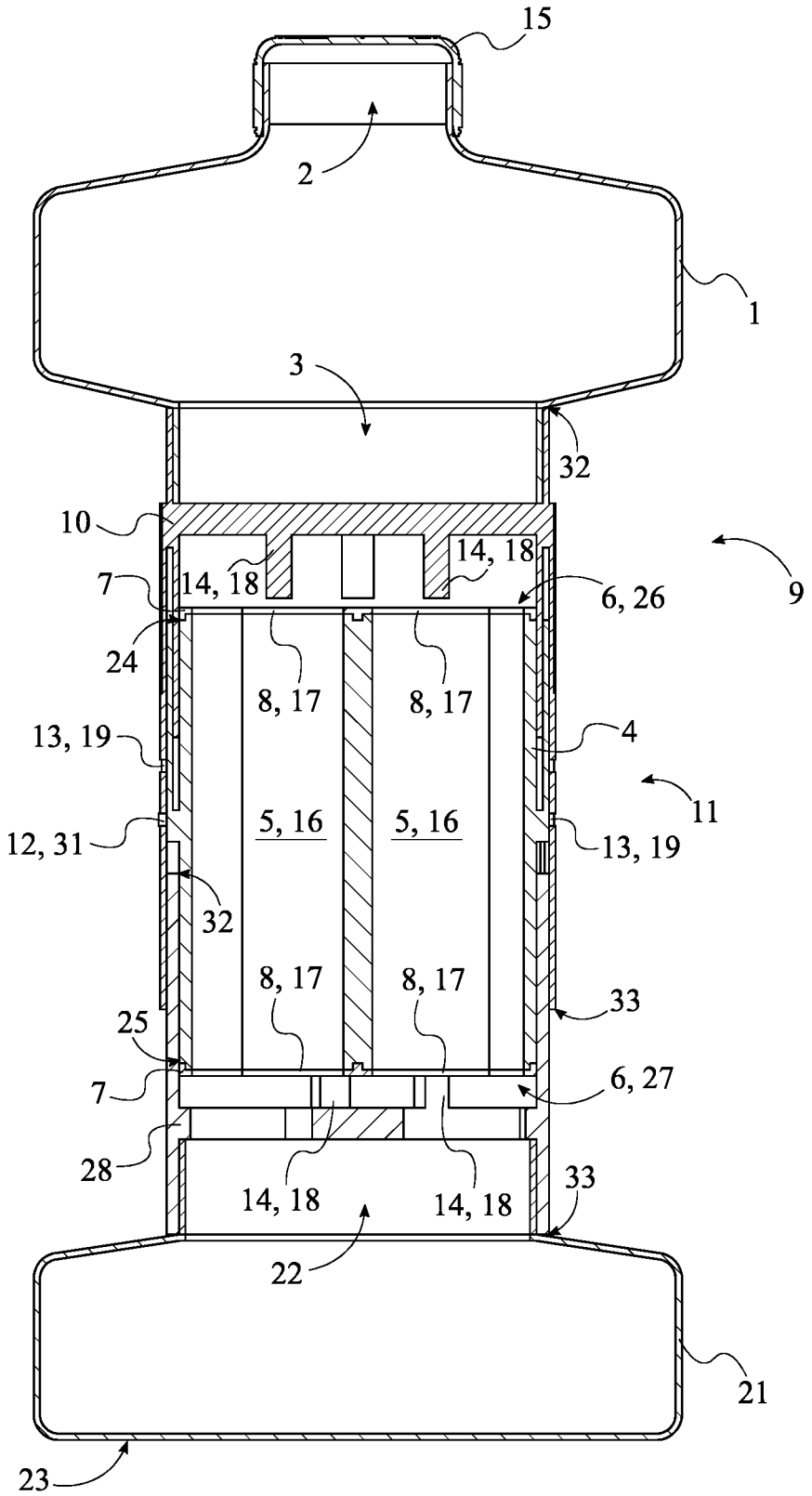
FIG. 37 is a vertical cross-sectional view taken in the direction of line 37-37 in FIG. 36.
Figure 38:
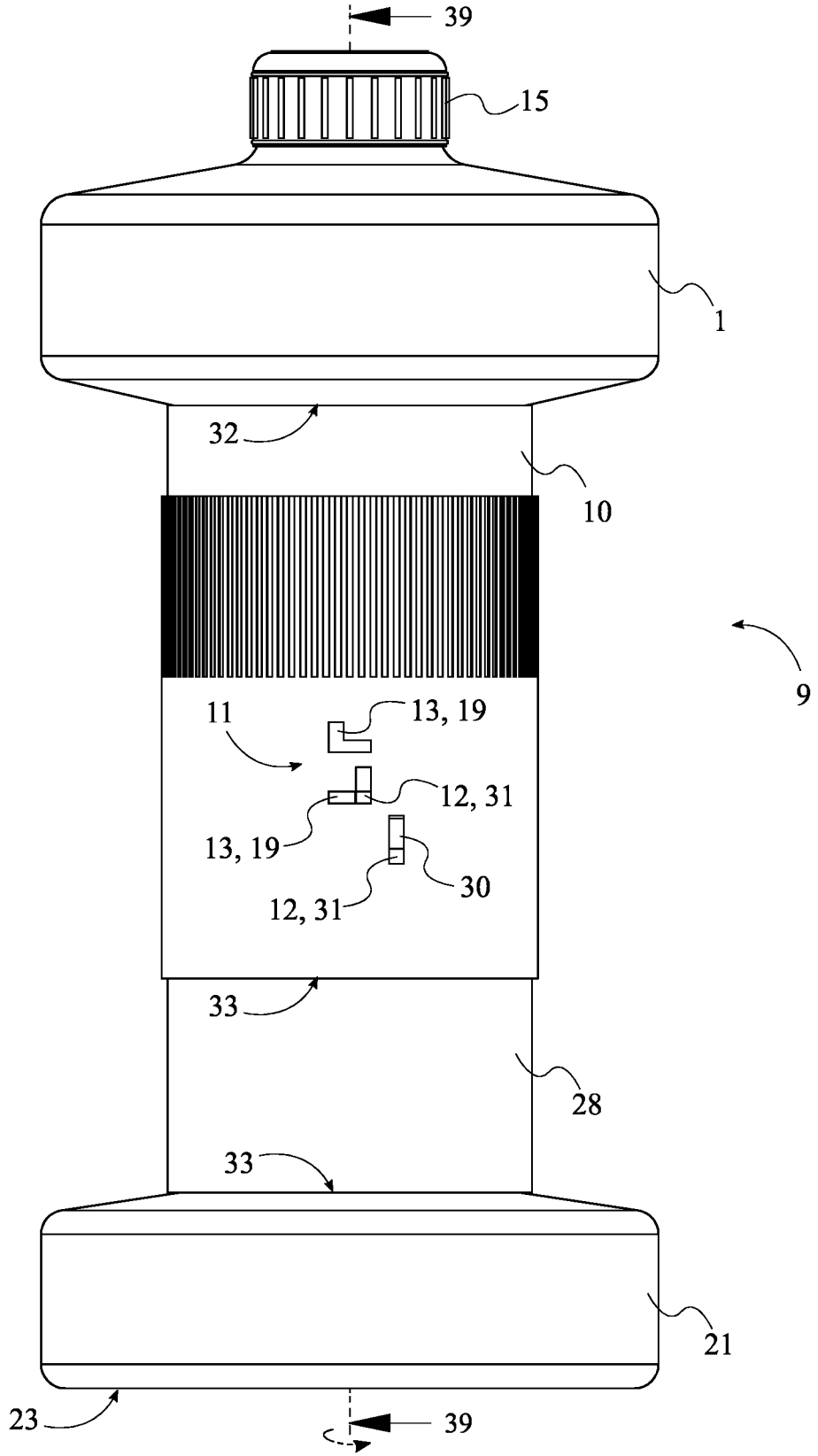
FIG. 38 is a front view of the double-container embodiment of the present invention, wherein the storage base is shown rotated counterclockwise.
Figure 39:
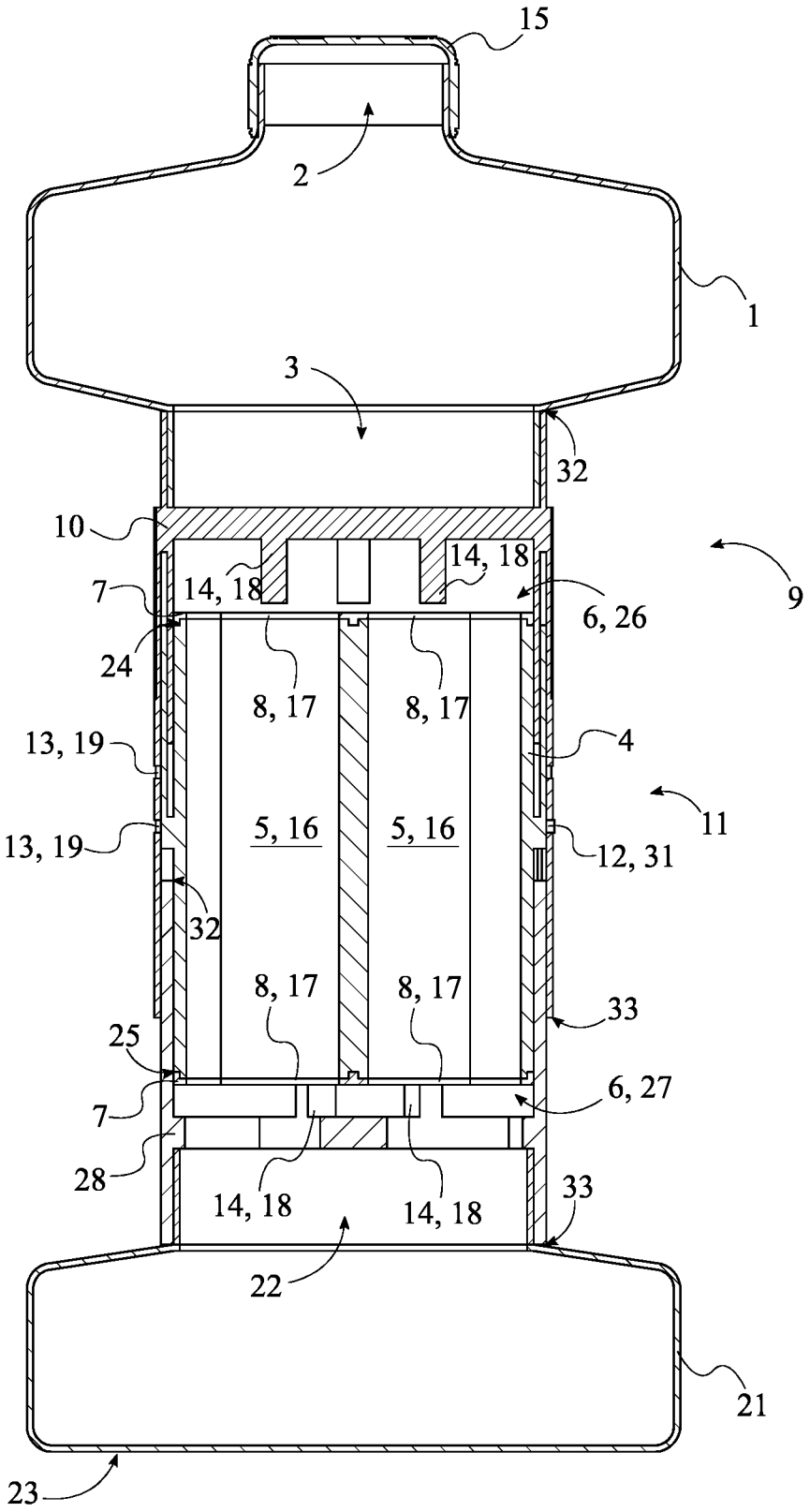
FIG. 39 is a vertical cross-sectional view taken in the direction of line 39-39 in FIG. 38.
Figure 40:
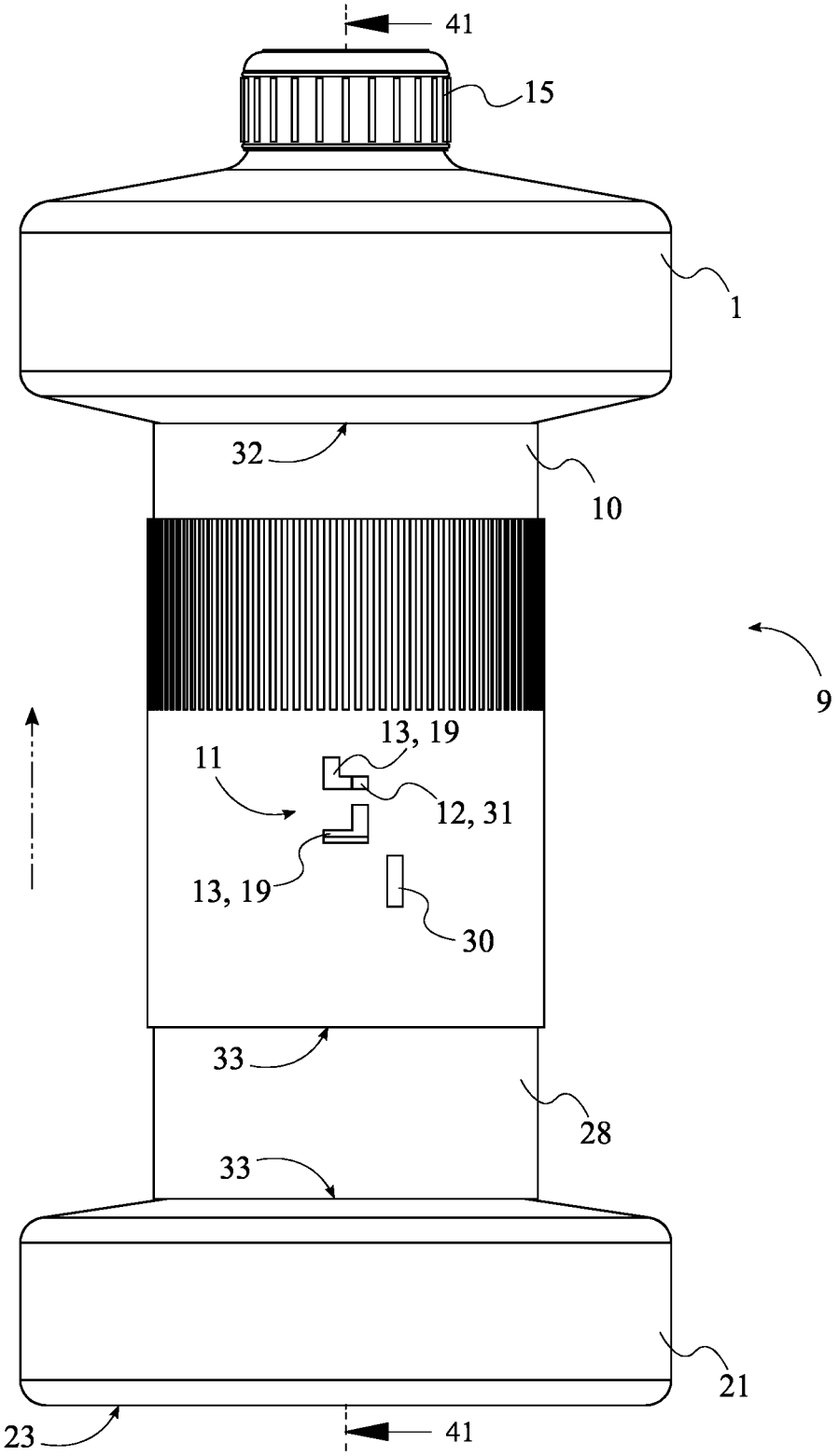
FIG. 40 is a front view of the double-container embodiment of the present invention, wherein the storage base is shown pushed towards the container body.
Figure 41:
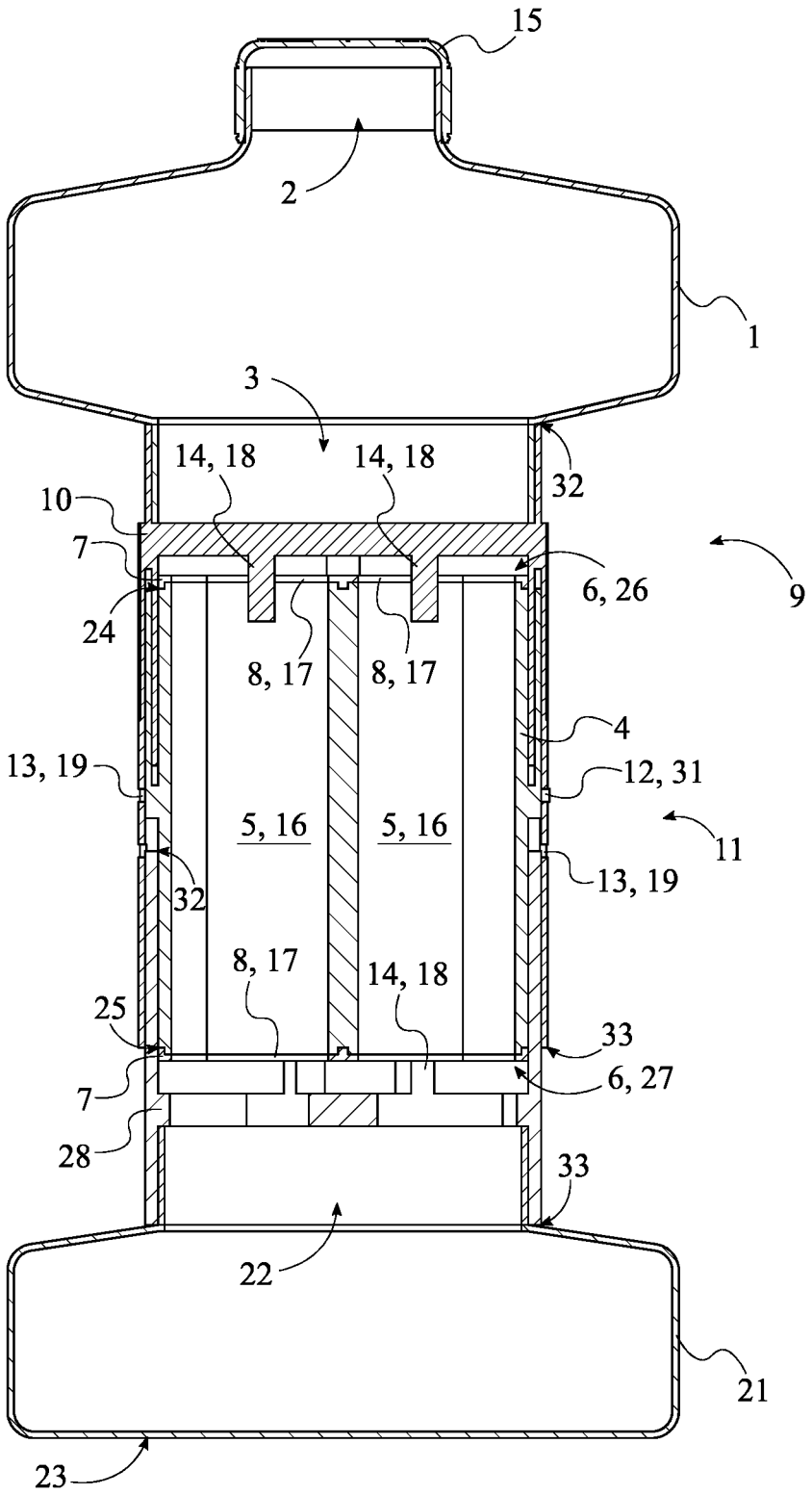
FIG. 41 is a vertical cross-sectional view taken in the direction of line 41-41 in FIG. 40.
Figure 42:
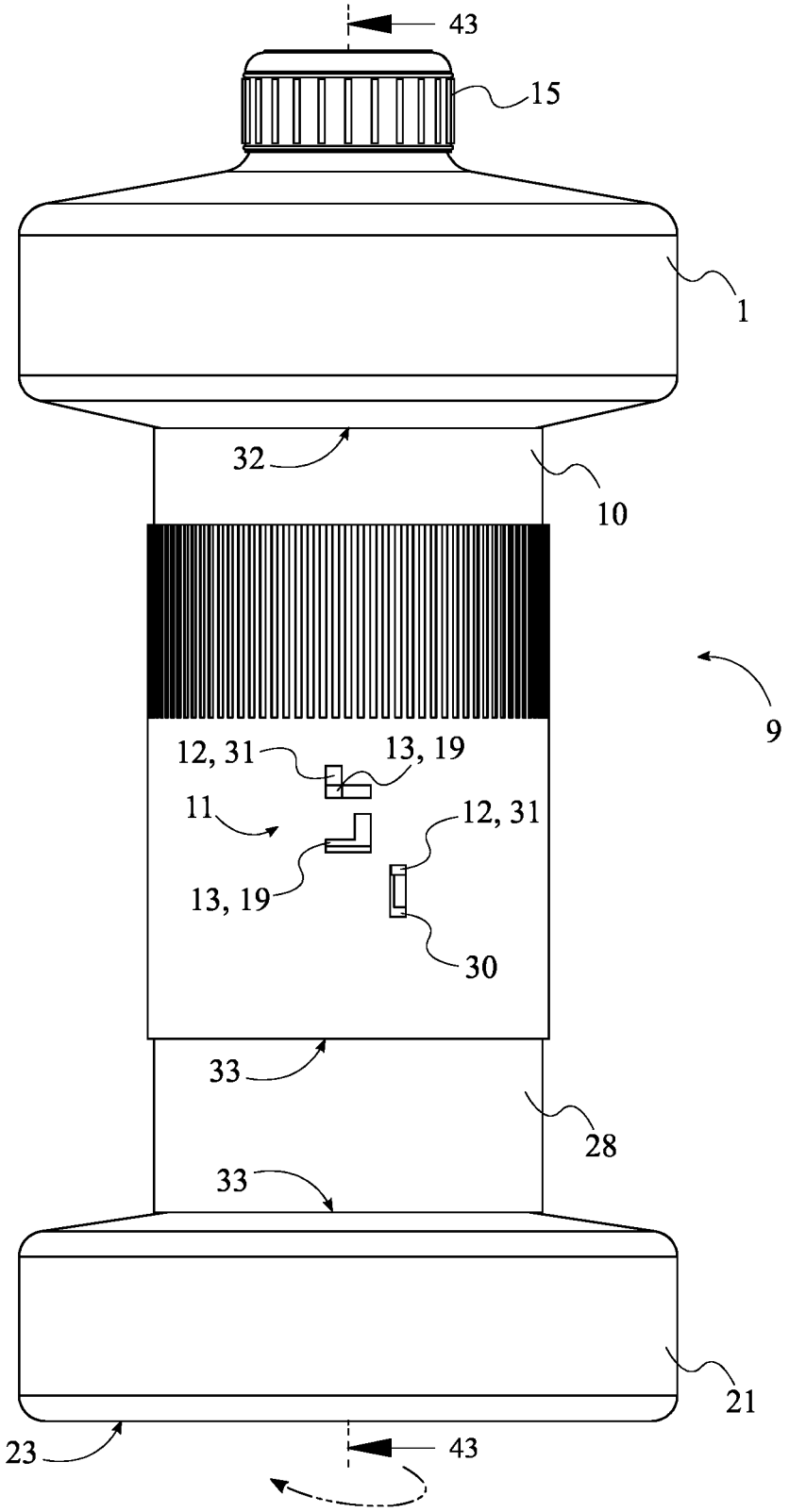
FIG. 42 is a front view of the double-container embodiment of the present invention, wherein the storage base is shown rotated clockwise.
Figure 43:
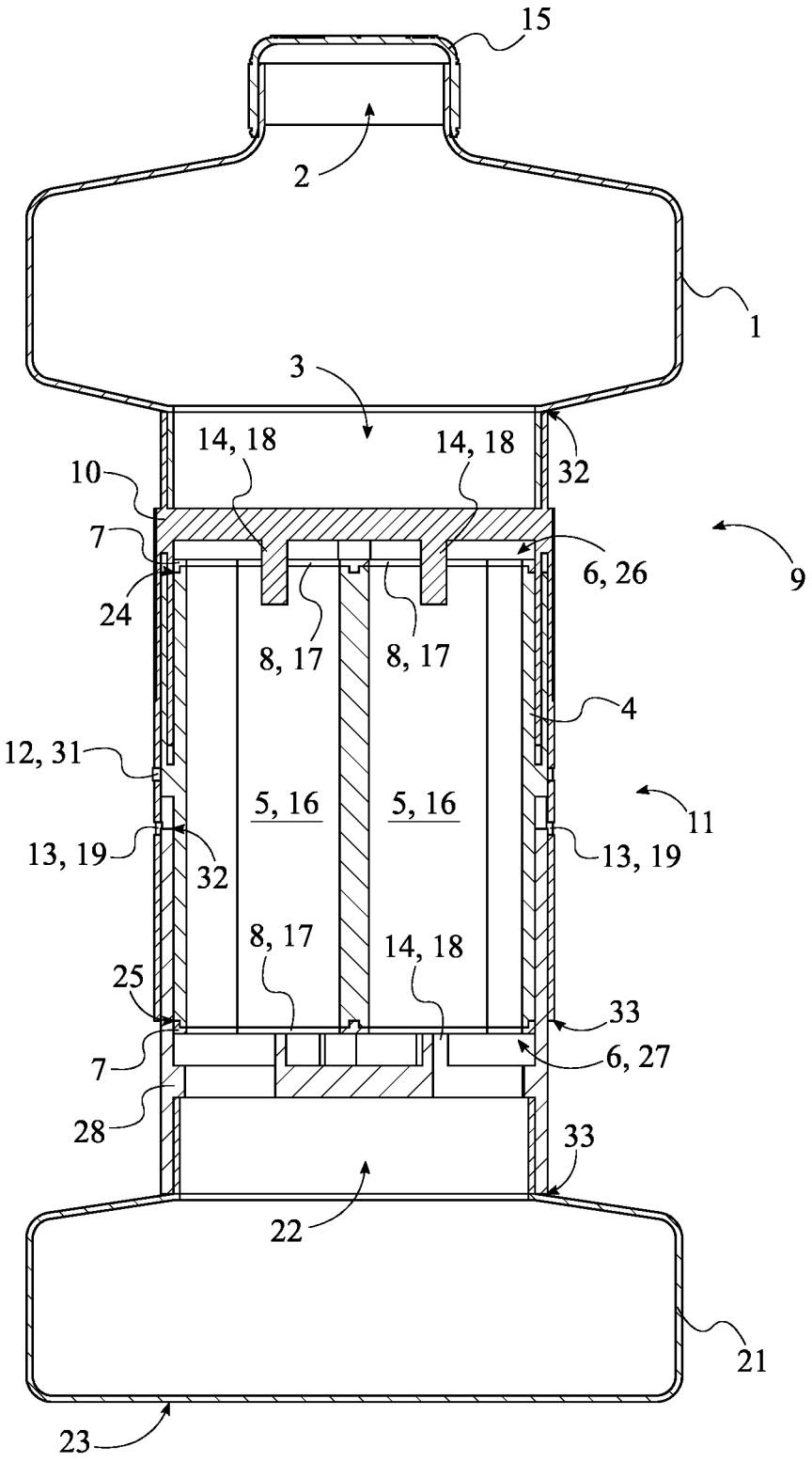
FIG. 43 is a vertical cross-sectional view taken in the direction of line 43-43 in FIG. 42.
Figure 44:
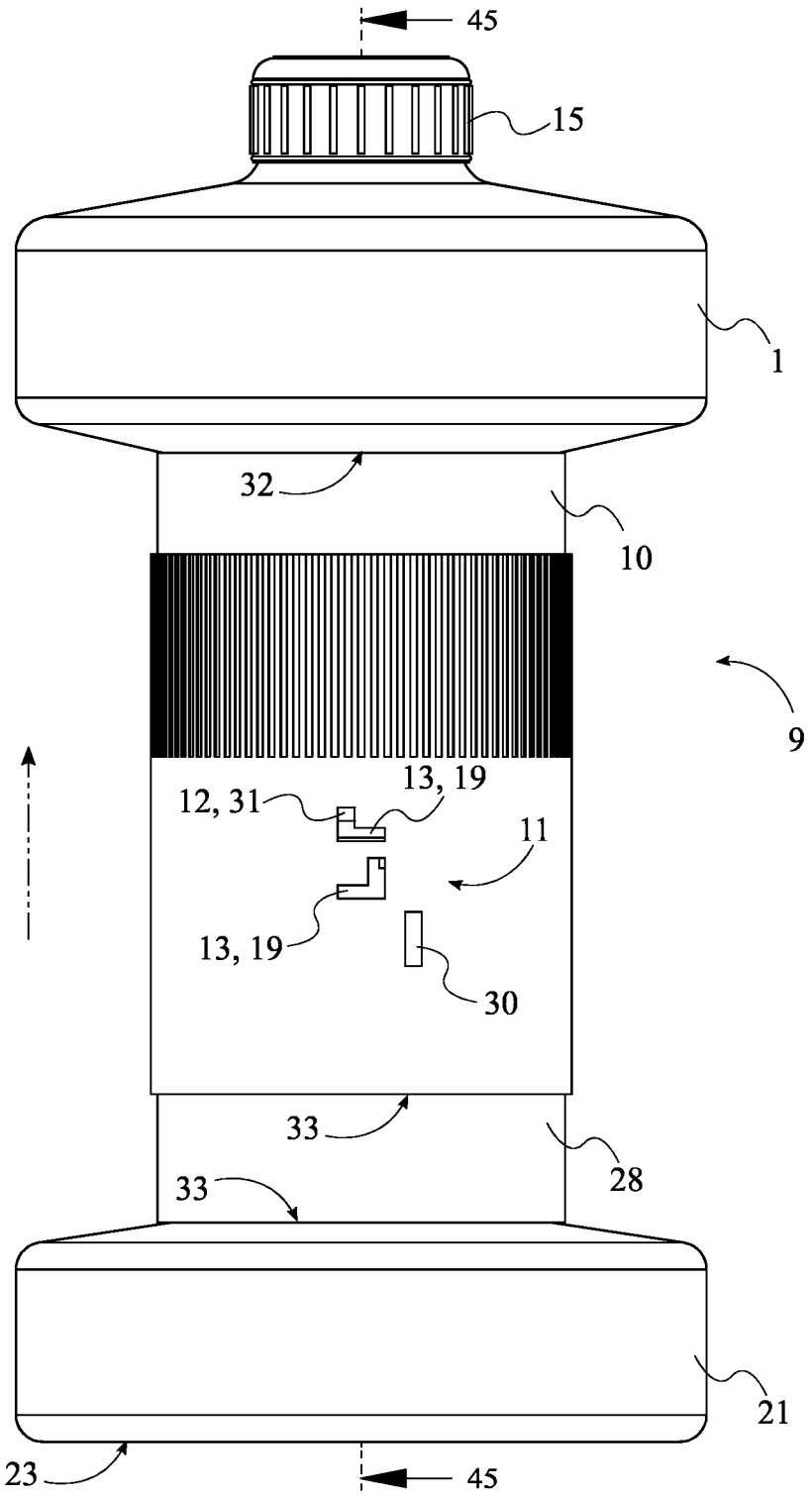
FIG. 44 is a front view of the double-container embodiment of the present invention, wherein the storage base is shown pushed towards the container body.
Figure 45:
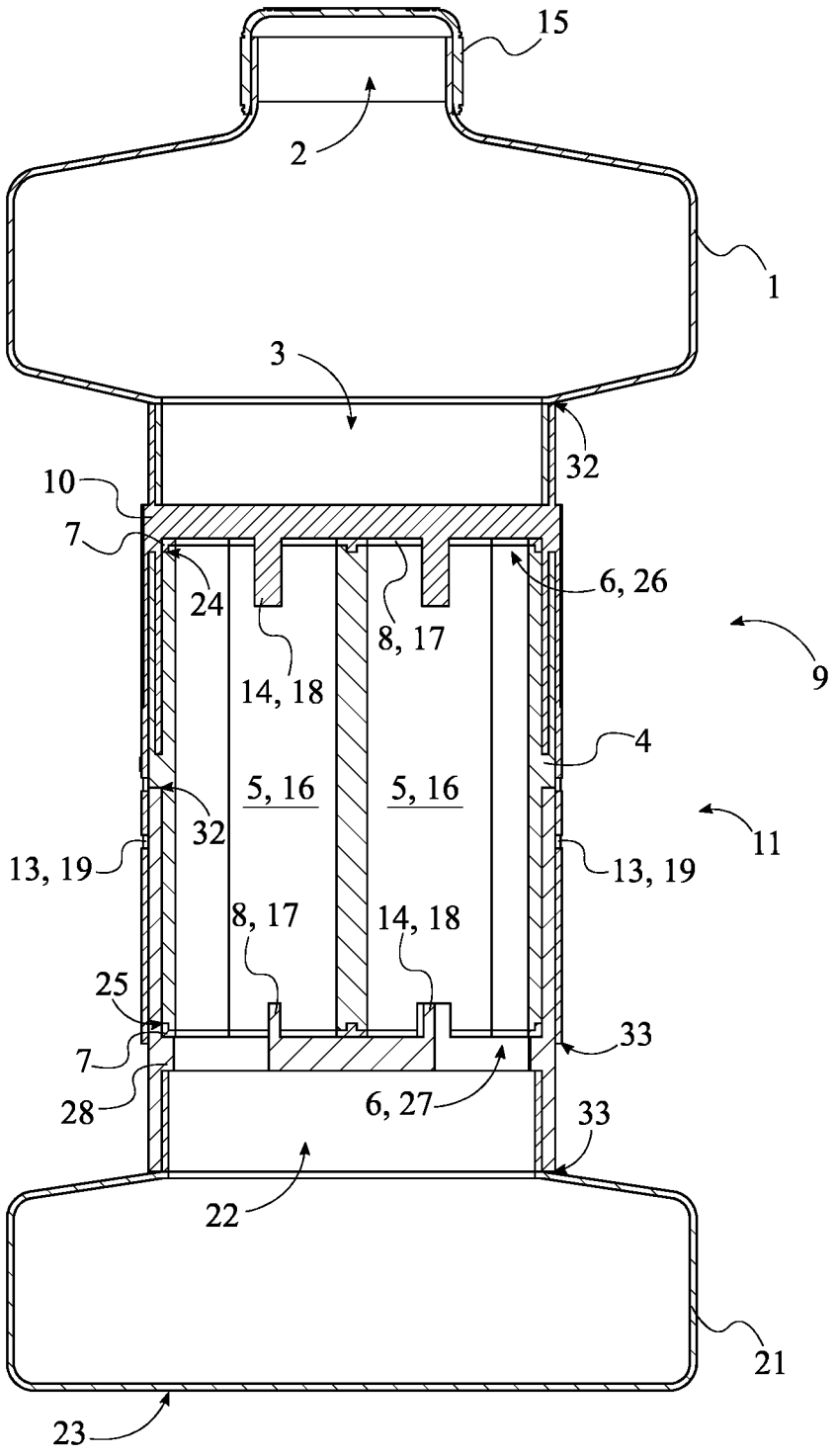
FIG. 45 is a vertical cross-sectional view taken in the direction of line 45-45 in FIG. 44.
Figure 46:
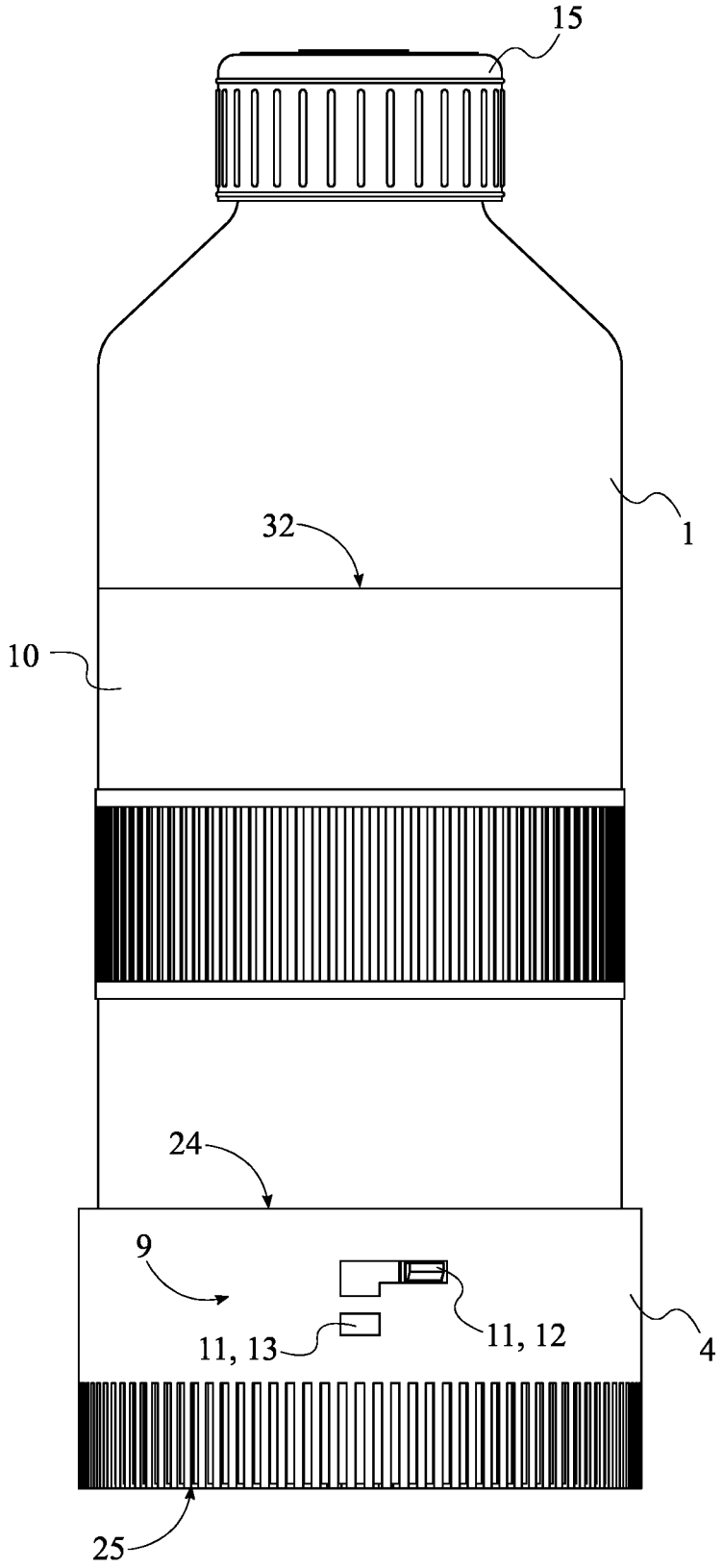
FIG. 46 is a front view of a second one-step embodiment of the present invention.
Figure 47:
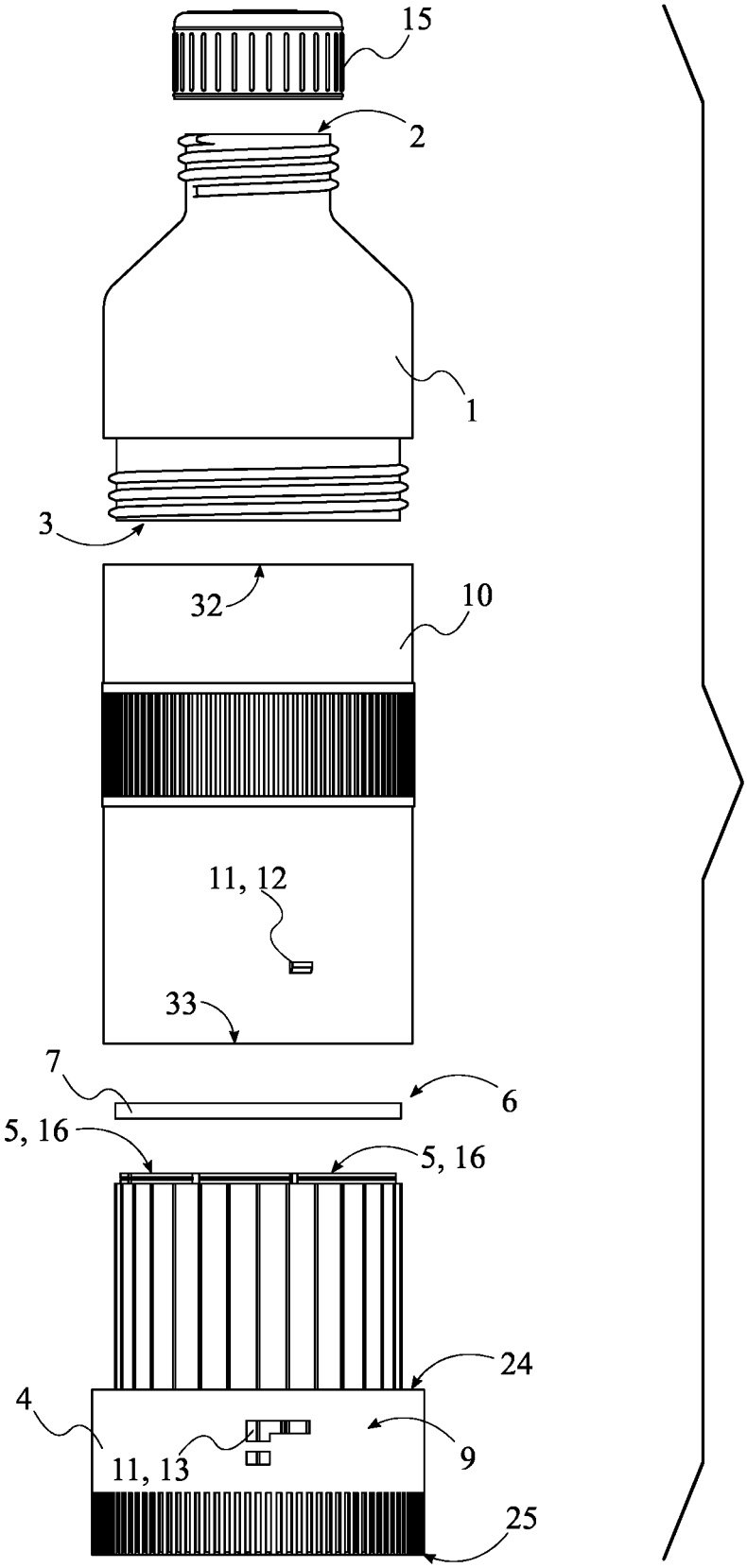
FIG. 47 is a front exploded view of the second one-step embodiment of the present invention.
Figure 48:
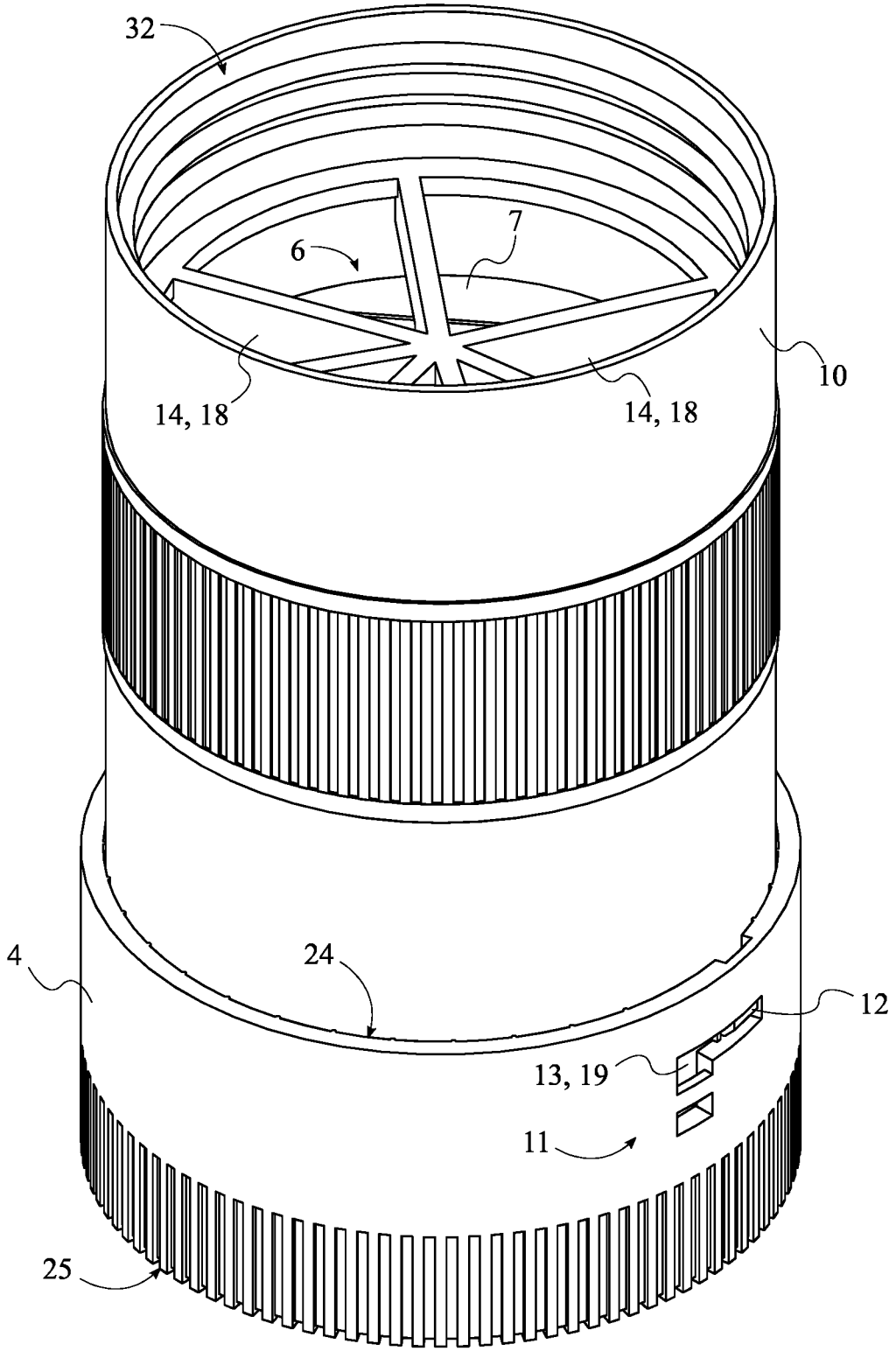
FIG. 48 is a top-front-right perspective view of the collar and the storage base of the second one-step embodiment of the present invention.
Figure 49:
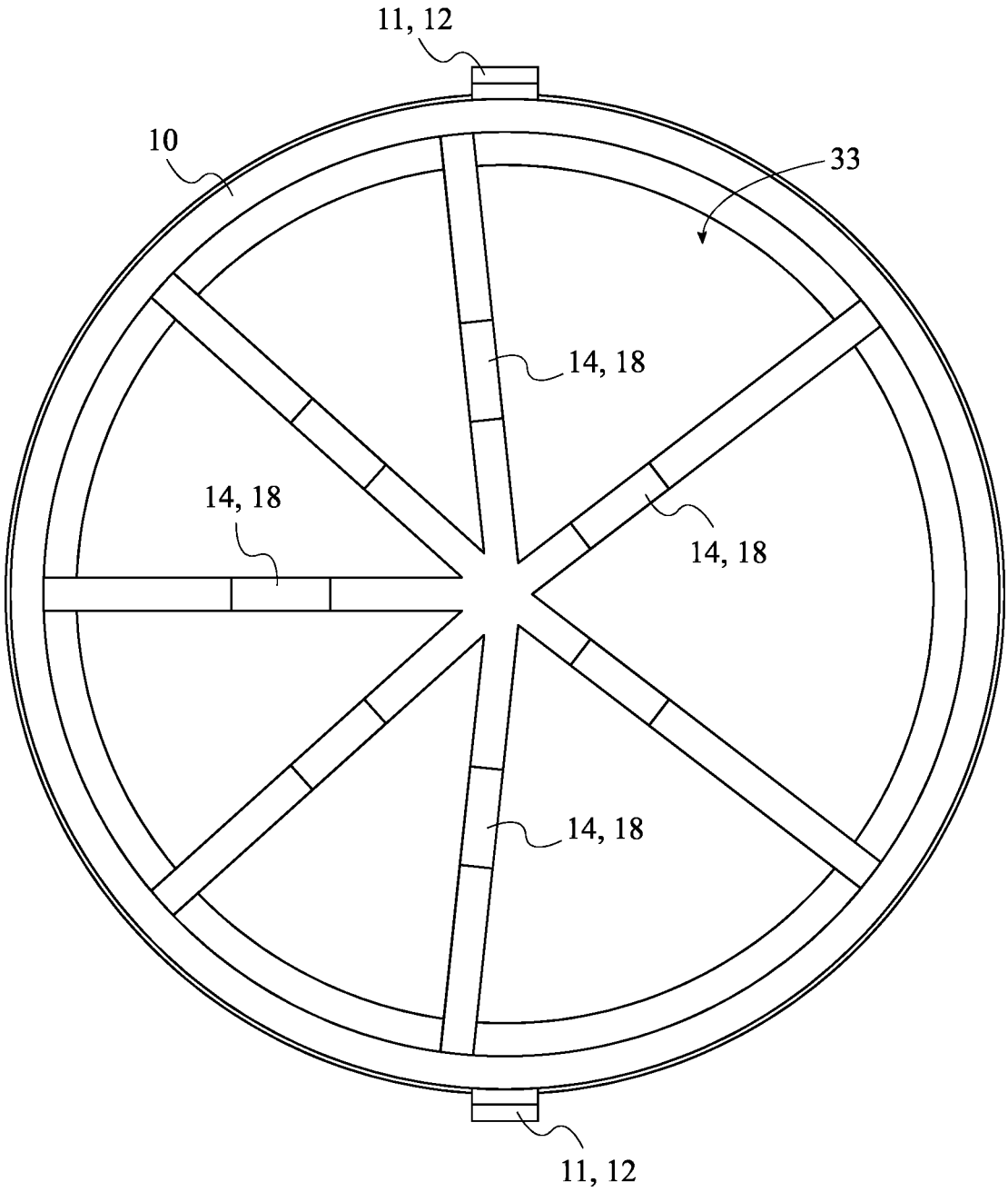
FIG. 49 is a bottom view of the collar of the second one-step embodiment of the present invention.
Figure 50:
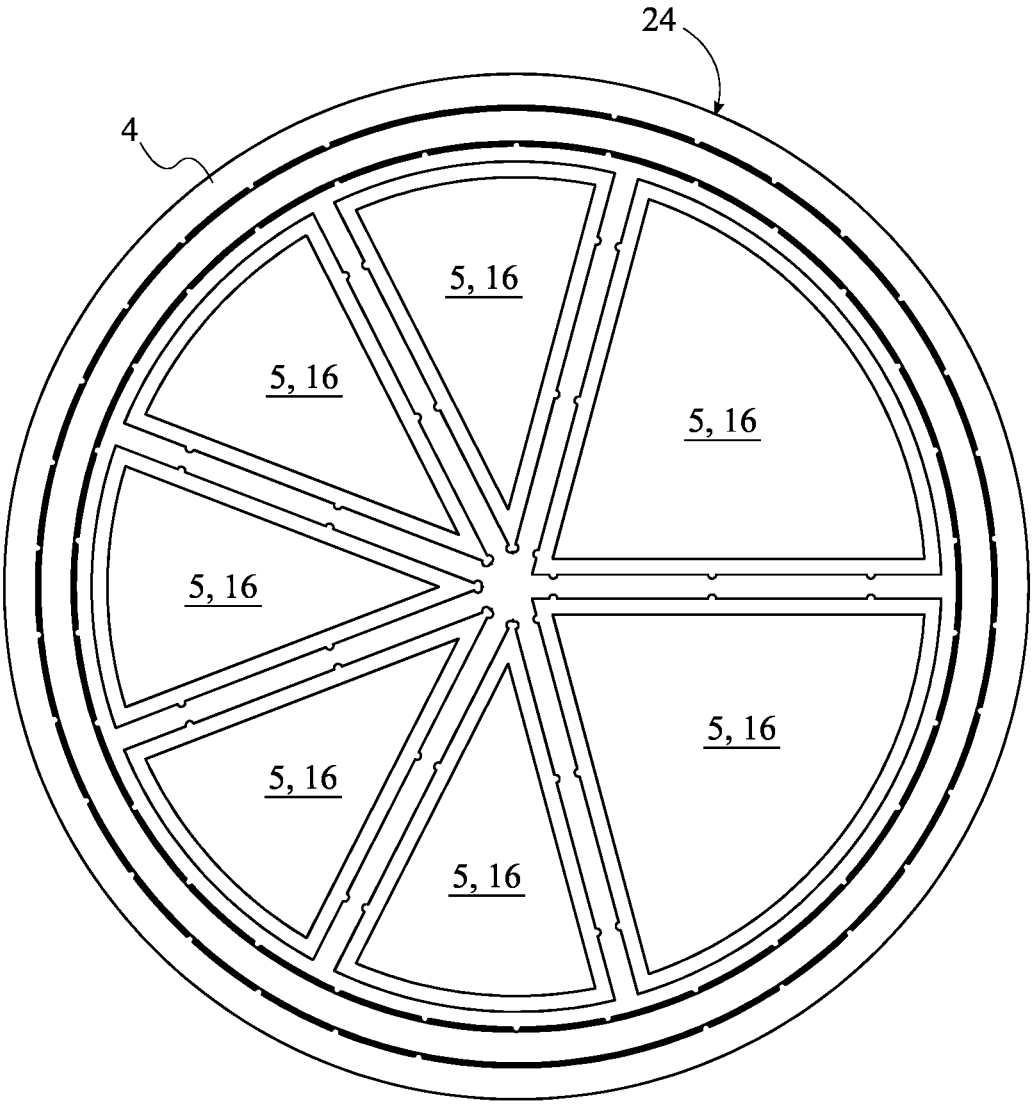
FIG. 50 is a top view of the storage base of the second one-step embodiment of the present invention.

The present invention can be designed to retain one beverage ingredient or multiple beverage ingredients. As can be seen in FIG. 12 through 14, to hold multiple beverage ingredients, the at least one storage chamber 5 may be a plurality of storage chambers 16, the at least one valve 8 may be a plurality of valves 17, and the at least one perforator 14 may be a plurality of perforators 18. The plurality of storage chambers 16 preferably includes multiple storage chambers that hold different beverage ingredients separate from each other. The number of valves preferably matches the number of storage chambers so that each storage chamber is sealed by a corresponding valve. To do so, the plurality of storage chambers 16 is radially distributed within the storage base 4. The plurality of valves 17 is also radially distributed about the cover body 7 to match the arrangement of the plurality of storage chambers 16. Further, a valve of the plurality of valves 17 is positioned coextensive with a specific storage chamber of the plurality of storage chambers 16. Similarly, a perforator of the plurality of perforators 18 is mounted within a specific storage chamber of the plurality of storage chambers 16. This way, each storage chamber has a corresponding valve and perforator, which enables the user to selectively mix a desired amount of an ingredient, or multiple ingredients, with the quantity of liquid within the container body 1.

As can be seen in FIG. 5 through 11, to enable the controlled movement of the storage base 4, the bayonet connector 11 comprises at least one pair of pins 12 and at least one pair of slots 13. The at least one pair of pins 12 is preferably two spring-loaded pins that slide within the corresponding slot. The at least one pair of slots 13 is preferably two L-shaped slots that guide the movement of the corresponding pin. To do so, the at least one pair of pins 12 is radially distributed about the cover body 7. The at least one pair of pins 12 is also externally and laterally mounted onto the cover body 7. This way, the two pins are positioned outside the cover body 7 and opposite to each other about the cover body 7. Similarly, the at least one pair of slots 13 is radially distributed about the storage base 4. The at least one pair of slots 13 is also integrated into the storage base 4. Thus, the at least one pair of slots 13 matches the position of the at least one pair of pins 12 to receive and guide the at least one pair of pins 12. Further, a pin of the at least one pair of pins 12 is slidably engaged with a slot of the at least one pair of slots 13. This way, to open the at least one valve 8 with the at least one perforator 14, the user rotates the storage base 4 until each pin of the at least one pair of pins 12 reaches the end of the corresponding slot of the at least one pair of slots 13. Then, the user pushes the storage base 4 towards the container body 1 which presses the at least one perforator 14 against the at least one valve 8 to open the at least one valve 8. This enables the mixing of the desired amount of the stored beverage ingredients with the quantity of liquid.

In a multi-step embodiment, the present invention is designed to enable the user to mix different beverage ingredients one by one, which gives greater control to the user of the beverage ingredients being mixed with the quantity of liquid. As can be seen in FIG. 15 through 18, in the multi-step embodiment, the additive dispensing mechanism 9 is designed to be separate from the storage base 4 to retain a larger amount of beverage ingredients within the at least one storage chamber 5. Like the first one-step embodiment, in the multi-step embodiment the at least one sealable cover 6 may comprise a cover body 7 and at least one valve 8. However, unlike the first one-step embodiment, the additive dispensing mechanism 9 may comprise a collar 10 and a bayonet connector 11. The cover body 7 is designed to match the interior of the storage base 4 so that the cover body 7 fits within the storage base 4. On the other hand, the collar 10 is designed to match the outer diameters of the second open end 3 and the storage base 4 to act as the intermediate piece between the storage base 4 and the container body 1. The collar 10 also increases the storage capacity of the container body 1, allowing for a greater quantity of liquid to be retained within the present invention. To control the mixing of the beverage ingredients with the quantity of liquid, the at least one valve 8 is positioned coextensive with the at least one storage chamber 5. The at least one valve 8 is also integrated into the cover body 7. The cover body 7 is positioned concentric with the storage base 4 so that the overall assembly of the cover body 7 with the storage base 4 is a short cylindrical structure. To form the short cylindrical structure, the cover body 7 is mounted within the storage base 4. Further, the collar 10 is axially oriented with the storage base 4 so that the overall assembly of the present invention is an elongated cylindrical structure. In addition, the collar 10 is threadably engaged with the second open end 3. Furthermore, the storage base 4 is rotatably connected with the collar 10 by the bayonet connector 11. This way, the user rotates the storage base 4 to engage the additive dispensing mechanism 9, which opens the at least one valve 8 to enable the mixing of the beverage ingredients with the quantity of liquid.

Similar to the first one-step embodiment, in the multi-step embodiment the additive dispensing mechanism 9 may also comprise at least one perforator 14. As can be seen in FIG. 15 through 21, the at least one perforator 14 is an elongated thin protrusion that is used to open the at least one valve 8. To do so, the at least one perforator 14 is positioned geometrical normal to the storage base 4. The at least one perforator 14 is further aligned with the at least one storage chamber 5 so that the at least one perforator 14 is pointed towards the at least one valve 8. Further, the at least one perforator 14 is mounted within the collar 10 so that only the desired at least one valve 8 is opened to enable the mixing of the quantity of liquid with the desired beverage ingredients. This way, when the at least one valve 8 is pressed against the at least one perforator 14, the at least one perforator 14 punctures the at least one valve 8, which enables the mixing of the beverage ingredient with the quantity of liquid.

The multi-step embodiment of the present invention is designed to retain multiple beverage ingredients that can be mixed individually with the quantity of liquid. As can be seen in FIG. 15 through 18, to hold multiple beverage ingredients, the at least one storage chamber 5 may also be a plurality of storage chambers 16, the at least one valve 8 may also be a plurality of valves 17, and the at least one perforator 14 may also be a plurality of perforators 18. The plurality of storage chambers 16 preferably includes multiple storage chambers that hold different beverage ingredients separate from each other. The number of valves preferably matches the number of storage chambers so that each storage chamber is sealed by a corresponding valve. To do so, the plurality of storage chambers 16 is radially distributed within the storage base 4. The plurality of valves 17 is also radially distributed about the cover body 7 to match the arrangement of the plurality of storage chambers 16. Further, a valve of the plurality of valves 17 is positioned coextensive with a specific storage chamber of the plurality of storage chambers 16. Similarly, a perforator of the plurality of perforators 18 is aligned with a specific storage chamber of the plurality of storage chambers 16. This way, each storage chamber has a corresponding valve and perforator, which enables the user to selectively mix a desired amount of an ingredient, or multiple ingredients, with the quantity of liquid within the container body 1.

In the multi-step embodiment, to enable the selective opening of each valve so that only the desired ingredients are mixed with the quantity of liquid, the plurality of perforators 18 is a plurality of perforators 18 of varying lengths, as can be seen in FIG. 15 through 21. This way, the user just moves the storage base 4 closer and closer to the container body 1 to open the desired valves. To enable the controlled movement of the storage base 4, the bayonet connector 11 comprises at least one pair of pins 12 and at least one pair of slots 13. The at least one pair of pins 12 is preferably two spring-loaded pins that slide within the corresponding pair of slots. The at least one pair of slots 13 is preferably two L-shaped slots that retain and guide the movement of the corresponding pins. To do so, the at least one pair of pins 12 is radially distributed about the storage base 4. The at least one pair of pins 12 is also externally and laterally mounted onto the storage base 4. This way, the two pins are positioned outside the storage base 4 and opposite to each other about the storage base 4. Similarly, the at least one pair of slots 13 is radially distributed about the collar 10 so that each of the individual slots is positioned opposite to each other. The at least one pair of slots 13 is also integrated into the collar 10 to receive the corresponding pin. Thus, the at least one pair of slots 13 matches the position of the at least one pair of pins 12 to receive the at least one pair of pins 12. Further, a pin of the at least one pair of pins 12 is slidably engaged with a slot of the at least one pair of slots 13. This way, to open the at least one valve 8 with the at least one perforator 14, the user rotates the storage base 4 until each pin of the at least one pair of pins 12 reaches the end of the corresponding slot of the at least one pair of slots 13. Then, the user pushes the storage base 4 towards the container body 1 which presses the at least one valve 8 against the at least one perforator 14 to puncture the at least one valve 8. This enables the mixing of the desired amount of the stored beverage ingredients with the quantity of liquid.

As can be seen in FIG. 22 through 31, in the multi-step embodiment, the at least one pair of slots 13 may be a plurality of pairs of slots 19 that control the movement of the storage base 4 along the collar 10 to control the mixing of the beverage ingredients with the quantity of liquid within the container body 1. To do so, the plurality of pairs of slots 19 is distributed along the collar 10 at lengths corresponding to the varying lengths of the plurality of perforators 18. In addition, the at least one pair of pins 12 is slidably engaged with a pair of slots of the plurality of pairs of slots 19. This way, the user rotates and pushes the storage base 4 into the collar 10 once to open a first seal, which enables the mixing of the quantity of liquid with the beverage ingredients within the corresponding chamber. After the user pushes the storage base 4 towards the container body 1, the at least one pair of pins 12 slides into the next pair of slots of the plurality of pairs of slots 19. Then, the user can rotate and push the storage base 4 into the collar 10 again to open the next storage chamber using the corresponding perforator and valve, thus releasing the beverage ingredients stored in the next storage chamber. The at least one pair of pins 12 then slides into the next pair of slots. The process can be repeated as necessary so that the desired ingredients are mixed with the quantity of liquid to make the custom beverage.

As previously mentioned, the present invention can be designed to be reused. However, the puncturing of the at least one valve 8 repeatedly with the at least one perforator 14 can cause wear and tear of the at least one valve 8, which may cause undesired mixing of the retained beverage ingredients with the quantity of fluid. As can be seen in FIG. 6 through 11, to help with the sealing of the at least one valve 8, the present invention may further comprise at least one replaceable seal 20. The at least one replaceable seal 20 helps prevent undesired mixing of the beverage ingredients with the quantity of liquid. In addition, the at least one replaceable seal 20 helps keep the retained beverage ingredients fresh. To do so, the at least one replaceable seal 20 is positioned coextensive with the at least one sealable cover 6 so that the whole surface of the at least one sealable cover 6 exposed to the quantity of liquid is covered. In addition, the at least one replaceable seal 20 is releasably attached onto the at least one sealable cover 6, opposite to the storage base 4. This way, the at least one storage chamber 5 is kept sealed until the at least one perforator 14 perforates both the at least one valve 8 and the at least one replaceable seal 20. After all the stored beverage ingredients have been utilized, the user can take the present invention apart for cleaning. Then, the user can restock the beverage ingredients in the at least one storage chamber 5, replace the at least one sealable cover 6, and apply a new at least one replaceable seal 20. Alternatively, the at least one replaceable seal 20 can be provided as a normal seal that may be utilized a single time by the user and discarded afterwards.

In a double-container embodiment, the present invention can be designed to carry different liquids to serve as base to make a custom beverage. The double-container embodiment is preferably designed to be used by gym enthusiasts. For example, many gym-goers want to consume specific beverages before and after the workout. Usually, this means that the user would have to carry two different containers which can be prepared at home or at the gym. On the other hand, the double-container embodiment enables the user to carry the ingredients to prepare both beverages in a single container. As can be seen in FIG. 32 through 35, to do so, the present invention may further comprise a supplemental container body 21 that holds another quantity of liquid that serves as base for one of the custom beverages. The supplemental container body 21 may have a shape and size matching the shape and size of the container body 1 but may also be designed differently to hold greater quantities of liquid or other beverage ingredients. The supplemental container body 21 comprises a supplemental open end 22 and a supplemental closed end 23, corresponding to the opening of the supplemental container body 21 and the closed base of the supplemental container body 21.

To connect the container body 1 to the supplemental container body 21 in the double-container embodiment, the present invention may further comprise a supplemental collar 28. As can be seen in FIG. 32 through 35, the supplemental collar 28 is designed to enable the user to selectively mix the quantity of liquid within the container body 1 separately from the quantity of liquid within the supplemental container body 21, if desired. To do so, the collar 10 and the supplemental collar 28 each comprises a first collar end 32 and a second collar end 33 corresponding to the terminal ends of each collar. Further, the storage base 4 is an open-ended structure so that the retained beverage ingredients can be mixed with either the quantity of liquids within the container body 1, the quantity of liquids within the supplemental container body 21, or both. To do so, the storage base 4 may comprise a first base end 24 and a second base end 25 corresponding to the terminal open ends of the storage base 4. Furthermore, to selectively cover both open ends of the storage base 4 until mixing, the at least one sealable cover 6 may be a first sealable cover 26 and a second sealable cover 27. Similar to the first one-step embodiment, the first sealable cover 26 and the second sealable cover 27 of the double-container embodiment are designed to seal the at least one storage chamber 5 within the storage base 4 at both open ends of the storage base 4.

As can be seen in FIG. 32 through 35, to form the structure of the double-container embodiment, the supplemental container body 21 and the supplemental collar 28 are axially aligned with the container body 1. The first collar end 32 of the container body 1 is connected to the second open end 3. The first sealable cover 26 is connected onto the first base end 24, while the second sealable cover 27 is connected onto the second base end 25. Then, the sealed first base end 24 is inserted into the collar 10 through the second collar end 33 of the collar 10. In some embodiments, to fill the storage chambers 5, the second sealable cover 27 would be sealed first so that the beverage ingredients already stored do not fall due to gravity. The first collar end 32 of the supplemental collar 28 is also inserted into the collar 10 through the second collar end 33 of the collar 10. The first collar end 32 of the supplemental collar 28 preferably encloses the second base end 25 when the supplemental collar 28 is inserted into the collar 10. Further, the supplemental open end 22 is connected into the second collar end 33 of the supplemental collar 21. Thus, the overall structure forms a dumbbell-shaped container that holds two quantities of liquid separate from each other as well as multiple beverage ingredients within the storage base 4.

Like the other embodiments, the double-container embodiment of the present invention enables the selective mixing of liquid bases with the beverage ingredients using the additive dispensing mechanism 9. As can be seen in FIG. 32 through 35, to do so, both the collar 10 and supplemental collar 28 each comprises the plurality of perforators 18 similar to the multi-step embodiment of the present invention to open the plurality of valves 17 on the first sealable cover 26 and on the second sealable cover 27, respectively. In the double-container embodiment, the storage base 4 also has the plurality of storage chambers 16, with several storage chambers matching the number of perforators of the plurality of perforators 18 on each collar. The plurality of perforators 18 on each collar is oriented towards the plurality of storage chambers 16 within the storage base 4. To selectively mix the beverage ingredients with the desired quantity of liquid in either the container body 1 or the supplemental container body 21, the additive dispensing mechanism 9 may comprise a bayonet connector 11 with the plurality of pairs of slots 19 and a plurality of pairs of pins 31. The supplemental collar 28 may also comprise a supplemental pair of slots 29 to receive a pair of pins from the plurality of pairs of pins 31. The plurality of pairs of pins 31 is radially distributed about the storage base 4. The plurality of pairs of pins 31 is also externally and laterally mounted onto the storage base 4 so that the plurality of pairs of pins 31 can engage with the corresponding pairs of slots. Further, the plurality of pairs of slots 19 is radially distributed about the collar 10 and integrated into the collar 10, while the supplemental pair of slots 29 is radially distributed about the supplemental collar 28 and integrated into the supplemental collar 28. The plurality of pairs of slots 19 is also distributed along the collar 10.

As can be seen in FIG. 32 through 35, to connect the storage base 4 to the collar 10, a pair of pins of the plurality of pins 31 is engaged with a pair of slots of the plurality of pairs of slots 19 on the collar 10. Similarly, to connect the storage base 4 to the supplemental collar 28, another pair of pins of the plurality of pins 31 is engaged with the supplemental pair of slots 29. This way, the user can mix the quantity of liquid within the container body 1 with the beverage ingredients within the storage base 4 by sliding the pair of pins engaged with the plurality of pairs of slots 19 on the collar 10. Similarly, the user can mix the quantity of liquid within the supplemental container body 21 with the beverage ingredients within the storage base 4 by sliding the pair of pins engaged with the supplemental pair of slots 29 on the supplemental collar 28.

Similar to the first one-step embodiment, the double-container embodiment may be designed to enable the mixing of the beverage ingredients in one step or in multiple steps. As can be seen in FIG. 36 through 45, to do so, the plurality of perforators 18 on the collar 10 and the supplemental collar 28 may be perforators of varying length. In addition, the plurality of pairs of pins 31 preferably includes two pair of pins, with one pair of pins positioned adjacent to the first base end 24, while the second pair of pins is positioned adjacent to the second base end 25. In a preferred multi-container embodiment, the quantity of liquid within the container body 1 is first mixed with the beverage ingredients within the storage base 4 by rotating the supplemental container body 21 counterclockwise and pushing the supplemental container body 21 towards the container body 1. The rotation and pushing of the supplemental container body 21 causes the supplemental collar 28 to also rotate and move into the collar 10 along with the storage base 4. The pair of pins engaged with the supplemental pair of slots 29 on the supplemental collar 28 guide the movement of the supplemental collar 28 until the plurality of perforators 18 within the collar 10 puncture the plurality of valves 17 on the first sealable cover 26, allowing the beverage ingredients to mix with the quantity of liquid within the container body 1. At the same time, the pair of pins engaged with the plurality of pairs of slots 19 on the collar 10 move from a first pair of slots to a second pair of slots closer to the first collar end 32 of the collar 10 as the rotation of the supplemental collar 28 by the supplemental container body 21 causes the storage base 4 to rotate as well. This is due to the plurality of pairs of pins 31 being arranged so that pairs of pins are laterally offset to each other.

After the beverage ingredients mix with the quantity of liquid within the container body 1, the first mixed beverage is ready for consumption after performing the first stage of the additive dispensing mechanism 9. The user can consume the mixed beverage by opening the cap 15 and drinking the first mixed beverage from the container body 1. After consuming the first mixed beverage, the user can place back the cap 15 and perform the second stage of the additive dispensing mechanism 9 to make the second mixed beverage by mixing the remaining ingredients in the at least one storage chamber 5 along with the liquid in the container body 21. To do so, the user rotates the supplemental container body 21 clockwise and pushes the supplemental container body 21 towards the container body 1 again. As can be seen in FIG. 36 through 45, the clockwise rotation and pushing of the supplemental container body 21 causes the storage base 4 to also rotate and move within the collar 10. The pair of pins engaged with the plurality of pairs of slots 19 moves along the second pair of slots until the plurality of perforators 18 within the supplemental collar 28 puncture the plurality of valves 17 on the second sealable cover 27, allowing the beverage ingredients to mix with the quantity of liquid within the supplemental container body 21. Therefore, the user would be able to consume two different beverages at two stages. For example, the first stage of the additive dispensing mechanism 9 would preferably produce a pre-workout drink by breaching a single storage chamber (capable of housing 14 grams of powder), allowing the powder to be mixed with the bottle on top while at the same time keeping the post-workout ingredients intact along with the water in the supplemental container body 21. When the user is done consuming the pre-workout drink, the user would be able to proceed with the second stage of the additive dispensing mechanism 9 by breaching the remaining three storage chambers (preferably capable of housing 42 grams of powder), holding the post-gym workout ingredients, allowing the powder to mix with the water in the supplemental container body 21, thus making the next beverage ready for consumption again.

Furthermore, due to the pair of pins of the plurality of pair of pins 31 adjacent to the second base end 25 and the supplemental pair of slots 29 being hidden within the collar 10 when the present invention is assembled, the collar 10 may further comprise a collar window 30. As can be seen in FIG. 32 through 45, the collar window 30 allows the user to keep track of the movement of the pair of pins of the plurality of pair of pins 31 adjacent to the second base end 25 along the supplemental pair of slots 29. To do so, the collar window 30 is laterally integrated into the collar 10. In addition, the collar window 30 is positioned adjacent to the second collar end 33 of the collar 10 and offset to the plurality of pairs of slots 19. This way, the collar window 30 matches the arrangement of the pair of pins of the plurality of pair of pins 31 adjacent to the second base end 25 and the supplemental pair of slots 29.

In a second one-step embodiment, the present invention is designed to hold the multiple beverage ingredients stored within the storage base 4 separate from the additive dispensing mechanism 9. The second one-step embodiment is preferably designed to carry multiple alcoholic beverages that can be selectively mixed to make a custom alcoholic beverage along with additional beverage ingredients, such as mint leaves, fresh fruit, etc. As can be seen in FIGS. 34, 35, and 46 through 50, to do so, the second one-step embodiment comprises a collar 10 similar to the multi-step embodiment. The collar 10 comprises a first collar end 32 and a second collar end 33 corresponding to the open ends of the collar 10. The storage base 4 comprises a plurality of storage chambers 16 integrated within the storage base 4 and radially distributed within the storage base 4. Similar to the multi-step embodiment, in the second one-step embodiment the plurality of perforators 18 is mounted within the collar 10. The plurality of perforators 18 is also radially distributed within the collar 10 and oriented towards the plurality of storage chambers 16 so that each chamber has a corresponding perforator. Unlike the first one-step embodiment, the plurality of storage chambers 16 protrude past the first base end 24 to hold greater amounts of beverage ingredients. However, like the first one-step embodiment, the second one-step embodiment comprises a similar at least one sealable cover 6 with a plurality of valves 17. The at least one sealable cover 6 is connected onto the plurality of storage chambers 16 so that each valve of the plurality of valves 17 covers a storage chamber of the plurality of storage chambers 16.

As can be seen in FIG. 46 through 50, to form the structure of the second one-step embodiment, the first collar end 32 is connected onto the second open end 3, while the second collar end 33 is connected onto the first base end 24. This way, the plurality of storage chambers 16 covered by the at least one sealable cover is positioned within the collar 10, adjacent to the plurality of perforators 18. In addition, to control the mixing of the beverage ingredients with the quantity of liquid, the second one-step embodiment also comprises a bayonet connector 11 similar to the first one-step embodiment. The bayonet connector 11 comprises at least one pair of pins 12 and at least one pair of slots 13, with the at least one pair of pins 12 being radially distributed about the collar 10. The at least one pair of pins 12 is also externally and laterally mounted onto the collar 10, adjacent to the second collar end 33. The at least one pair of slots 13 is radially distributed about the storage base 4. The at least one pair of slots 13 is also integrated into the storage base 4. Thus, the at least one pair of slots 13 matches the position of the at least one pair of pins 12 to receive and guide the at least one pair of pins 12. This way, to open the plurality of valves 17 with the plurality of perforators 18, the user rotates the storage base 4 until each pin of the at least one pair of pins 12 reaches the end of the corresponding slot of the at least one pair of slots 13. Then, the user pushes the storage base 4 towards the container body 1 which presses the plurality of perforators 18 against the plurality of valves 17 to puncture the plurality of valves 17. This enables the mixing of the desired amount of the stored beverage ingredients with the quantity of liquid.

Although the invention has been explained in relation to its preferred embodiment, it is to be understood that many other possible modifications and variations can be made without departing from the spirit and scope of the invention.

What is claimed is:

1. A multi-chamber mixing beverage container comprising a container body;

a storage base;

an additive dispensing mechanism;

a cap;

the container body comprising a first open end and a second open end;

the storage base comprising at least one storage chamber and at least one sealable cover;

the at least one storage chamber being integrated within the storage base;

the at least one sealable cover being positioned coextensive with the at least one storage chamber;

the at least one sealable cover being mounted within the storage base;

the storage base being axially oriented with the container body;

the storage base being in fluid communication with the second open end;

the cap being threadably engaged with the first open end;

the additive dispensing mechanism being operatively connected to the storage base, wherein the additive dispensing mechanism is used to selectively perforate the at least one sealable cover;

the at least one sealable cover comprising a cover body and at least one valve;

the additive dispensing mechanism comprising a collar and a bayonet connector;

the at least one valve being positioned coextensive with the at least one storage chamber;

the at least one valve being integrated into the cover body;

the cover body being positioned concentric with the storage base;

the cover body being mounted within the storage base;

the collar being axially oriented with the storage base;

the collar being threadably engaged with the second open end;

the storage base being rotatably connected with the collar by the bayonet connector;

the additive dispensing mechanism further comprising at least one perforator;

the at least one perforator being positioned geometrical normal to the storage base;

the at least one perforator being aligned with the at least one storage chamber;

the at least one perforator being mounted within the collar;

the at least one storage chamber being a plurality of storage chambers;

the at least one valve being a plurality of valves;

the at least one perforator being a plurality of perforators;

the plurality of storage chambers being radially distributed within the storage base;

the plurality of valves being radially distributed about the cover body;

the plurality of perforators being radially distributed within the collar;

a valve of the plurality of valves being positioned coextensive with a specific storage chamber of the plurality of storage chambers; and a perforator of the plurality of perforators being aligned a specific storage chamber of the plurality of storage chambers.

2. The multi-chamber mixing beverage container as claimed in claim 1, wherein the plurality of perforators is a plurality of perforators of varying lengths.

3. The multi-chamber mixing beverage container as claimed in claim 1 comprising:

the bayonet connector comprising at least one pair of pins and at least one pair of slots;

the at least one pair of pins being radially distributed about the storage base;

the at least one pair of pins being externally and laterally mounted onto the storage base;

the at least one pair of slots being radially distributed about the collar;

the at least one pair of slots being integrated into the collar; and a pin of the at least one pair of pins being slidably engaged with a slot of the at least one pair of slots.

4. The multi-chamber mixing beverage container as claimed in claim 3 comprising:

the at least one pair of slots being a plurality of pairs of slots;

the plurality of pairs of slots being distributed along the collar; and the at least one pair of pins being slidably engaged with a pair of slots of the plurality of pairs of slots.

5. The multi-chamber mixing beverage container as claimed in claim 1 comprising:

at least one replaceable seal;

the at least one replaceable seal being positioned coextensive with the at least one sealable cover; and the at least one replaceable seal being releasably attached onto the at least one sealable cover, opposite to the storage base.

* * * * *